US011744293B2

(12) United States Patent
Liu et al.

(10) Patent No.: US 11,744,293 B2
(45) Date of Patent: Sep. 5, 2023

(54) ELECTRONIC CIGARETTE

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Hong Yu, Hunan (CN); Yuangang Dai, Hunan (CN); Xinqiang Yin, Hunan (CN); Jianhua Yi, Hunan (CN); Yongquan Zhou, Hunan (CN); Chaoxiang Huang, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 412 days.

(21) Appl. No.: 16/772,700

(22) PCT Filed: Dec. 14, 2018

(86) PCT No.: PCT/CN2018/121195
§ 371 (c)(1),
(2) Date: Jun. 12, 2020

(87) PCT Pub. No.: WO2019/114821
PCT Pub. Date: Jun. 20, 2019

(65) Prior Publication Data

US 2020/0323263 A1 Oct. 15, 2020

(30) Foreign Application Priority Data

Dec. 14, 2017 (CN) ..... CN201711339843.4
Dec. 14, 2017 (CN) ..... CN201721744865.4
(Continued)

(51) Int. Cl.
*A24F 40/40* (2020.01)
*A24F 40/60* (2020.01)
(Continued)

(52) U.S. Cl.
CPC ..... *A24F 40/60* (2020.01); *A24F 40/05* (2020.01); *A24F 40/40* (2020.01); *A24F 40/50* (2020.01); *A24F 40/10* (2020.01)

(58) Field of Classification Search
CPC ..... A24F 40/40
See application file for complete search history.

(56) References Cited

U.S. PATENT DOCUMENTS 10,357,061 B2 * 7/2019 Li ..... A61M 15/0023
2019/0124986 A1 * 5/2019 Blattler ..... A24D 3/17

FOREIGN PATENT DOCUMENTS

CN 204070523 U 1/2015
CN 206227718 U 6/2017
(Continued)

OTHER PUBLICATIONS

Machine Translation of CN 204070523 (Year: 2015).*
International Search Report issued in International Application No. PCT/CN2018/121195 dated Feb. 27, 2019, 3 pages.

*Primary Examiner* — Russell E Sparks
(74) *Attorney, Agent, or Firm* — Mauriel Kapouytian Woods LLP; Liang Huang; Ran Pang

(57) ABSTRACT

An electronic cigarette is disclosed. The electronic cigarette includes a housing (1) and an atomization assembly (2) disposed in the housing (1). The electronic cigarette also includes a fixing mechanism (3) capable of fixing the atomization assembly (2), an unlocking mechanism (4) for controlling the fixing mechanism (3) to be relatively fixed to or separated from the atomization assembly (2), and an elastic mechanism (5) for ejecting the atomization assembly (2) outward when the fixing mechanism (3) is separated
(Continued)

from the atomization assembly (2). The atomization assembly (2) can be ejected for replacement without contacting the atomization assembly (2) by hand, thereby preventing scalding and staining the hand. A top cover assembly (23) can be automatically opened only by pressing a sliding assembly (38) to replace a cartridge. The top cover assembly (23) can be reset by pushing to avoid misalignment.

19 Claims, 31 Drawing Sheets

(30) Foreign Application Priority Data

Dec. 14, 2017 (CN) ..... CN201721745519.8
Dec. 14, 2017 (CN) ..... CN201721745547.X

(51) Int. Cl.

| | |
|---|---|
| ***A24F 40/05*** | (2020.01) |
| ***A24F 40/50*** | (2020.01) |
| *A24F 40/10* | (2020.01) |

(56) References Cited

FOREIGN PATENT DOCUMENTS

| | | |
|---|---|---|
| CN | 206687168 U | 12/2017 |
| CN | 207613207 U | 7/2018 |
| CN | 207613208 U | 7/2018 |
| CN | 207733663 U | 8/2018 |
| CN | 207754549 U | 8/2018 |
| EP | 3 100 622 A1 | 7/2016 |

* cited by examiner

ELECTRONIC CIGARETTE

CROSS REFERENCE TO RELATED APPLICATIONS

This application is a U.S. National Phase application under 35 U.S.C. § 371 of International Application No. PCT/CN2018/121195 filed on Dec. 14, 2018, which claims priority to Chinese Application Number 201711339843.4 filed on Dec. 14, 2017, Chinese Application Number 201721744865.4 filed on Dec. 14, 2017, Chinese Application No. 201721745519.8 filed on Dec. 14, 2017 and Chinese Application Number 201721745547.X filed on Dec. 14, 2017.

FIELD OF THE INVENTION

The present invention particularly relates to an electronic cigarette.

BACKGROUND OF THE INVENTION

An electronic cigarette includes a housing, an atomization assembly and a cartridge are disposed in the housing, an upper cover assembly is disposed at the top of the housing, a suction nozzle is connected to the upper cover assembly, the cartridge is filled with a smoking material, and an air outlet channel communicated with the suction nozzle is disposed in the housing. When the electronic cigarette operates, the cartridge is heated by the atomization assembly to generate smoke, and the smoke sequentially passes through the air outlet channel and the suction nozzle to enter the user's mouth for the user to smoke.

The existing electronic cigarette has the following disadvantages:

1. The atomization assembly needs to be pulled out by hand for replacement, which easily scalds and stains hands, and is time-consuming and laborious.

2. When the atomization assembly and the cartridge are replaced, the upper cover assembly needs to be removed from the housing, then the atomization assembly and the cartridge are replaced, and the upper cover assembly is finally mounted. However, the upper cover assembly is mostly disassembled and assembled by plugging, screwing, etc., so the operation is complicated, the misalignment is prone to occur, the operation is time-consuming and laborious, and the user experience is poor.

3. For easy operation, a side panel of the housing is used as a large key, and a pressing portion on the inner side of the large key is opposite to a switch key in the housing which controls the operation of the electronic cigarette. When the user presses the large key, the pressing portion touches the switch key, an operating circuit of the electronic cigarette is turned on, and the electronic cigarette begins to work; and when the user releases the large key, the pressing portion is separated from the switch key, the operating circuit of the electronic cigarette is cut off, and the electronic cigarette stops working. When the user opens the cover to replace the cartridge, the hand is likely to press the large key, and the switch key is touched by mistake to turn on the operating circuit of the electronic cigarette, resulting in dry burning of the atomization assembly, thereby shortening the service life of the atomization assembly and increasing the use cost.

4. When the upper cover assembly is mounted, the air outlet channel and the suction nozzle may be misaligned, resulting in poor sealing performance at the connection between the suction nozzle and the air outlet channel, and the smoke leakage easily occurs through the gap at the connection between the suction nozzle and the air outlet channel to affect the smoking effect.

SUMMARY OF THE INVENTION

The present invention is directed to provide an improved electronic cigarette in view of the above disadvantages of the prior art, where an atomization assembly can be ejected for replacement without contacting the atomization assembly by hand, thereby preventing scalding and staining the hand; a top cover assembly can be automatically opened only by pressing a sliding assembly to replace a cartridge; the top cover assembly can be reset by pushing to avoid misalignment; the two operations of replacing the cartridge and pressing a large key cannot be performed simultaneously, which prevents dry burning of the atomization assembly caused by accidentally touching the large key; the alignment of a suction nozzle and an air outlet channel can be automatically corrected, so that the sealing performance at the connection between the suction nozzle and the air outlet channel is good, and smoke leakage is prevented; and the electronic cigarette is simple to operate, convenient, fast, and good in user experience.

In order to solve the above technical problems, the technical solution adopted by the present invention is as follows:

An electronic cigarette is provided, including a housing, an atomization assembly being disposed in the housing, and the structure feature of the electronic cigarette is that it also includes a fixing mechanism capable of fixing the atomization assembly, an unlocking mechanism for controlling the fixing mechanism to be relatively fixed to or separated from the atomization assembly, and an elastic mechanism for ejecting the atomization assembly outward when the fixing mechanism is separated from the atomization assembly.

With the above structure, when the atomization assembly is replaced, the unlocking mechanism controls the fixing mechanism to be separated from the atomization assembly, and the elastic mechanism immediately ejects the atomization assembly outward, so that the atomization assembly can be ejected for replacement without contacting the atomization assembly by hand, the hand is prevented from being scalded and stained, and the operation is simple, practical and convenient.

As a preferred mode, the electronic cigarette also includes a sliding column at the top of the housing, the atomization assembly is disposed in a groove at the top of the sliding column, the fixing mechanism includes a slider disposed in a receiving hole of the sliding column and movable perpendicular to the length of the electronic cigarette, and a buckling portion capable of fixing the atomization assembly is provided at the end of the slider close to the atomization assembly.

As a preferred mode, the unlocking mechanism includes a rotating tongue, a rotating shaft and an ejector rod all disposed in the housing, the ejector rod is movable along the length of the electronic cigarette, the middle of the rotating tongue is connected to the sliding column through the rotating shaft, the rotating tongue can rotate around the rotating shaft, one end of the rotating tongue extends into a groove at the bottom of the slider, the other end of the rotating tongue is opposite to a top end of the ejector rod, and the top end of the ejector rod can push the rotating tongue to rotate and drive the slider through the rotating tongue to be separated from the atomization assembly.

When the atomization assembly needs to be replaced, the ejector rod is pushed upward, the ejector rod lifts the rotating tongue, then the rotating tongue rotates around the rotating shaft, so that the slider slides with the rotation of the rotating tongue, the atomization assembly is released from the fixing effect of the buckling portion on the slider, the atomization assembly is ejected by the elastic mechanism, and the atomization assembly can be replaced.

Further, the fixing mechanism also includes a second spring, one end of the second spring abuts against the end of the slider away from the atomization assembly, and the other end of the second spring abuts against an inner side wall of the housing.

The slider can be quickly reset with the second spring.

As a preferred mode, the unlocking mechanism also includes a key block disposed at the bottom of the housing and capable of pushing the ejector rod to move.

Further, a fourth spring for controlling the ejector rod to reset is sleeved outside the ejector rod.

The ejector rod can be quickly reset with the fourth spring.

Further, the sliding column is provided with a limiting step opposite to the second spring for limiting the slider.

Further, a first plane is provided on an inner side wall of the receiving hole to prevent the slider from rotating, and a second plane corresponding to the first plane is provided on the slider.

As a preferred mode, the elastic mechanism includes a top column and a first spring both disposed in a groove at the bottom of the sliding column, and the first spring abuts between the sliding column and the top column.

Further, a lug is provided on an outer side wall of the top column, a mounting groove corresponding to the lug is formed on a side wall of the sliding column, a rotation guide slot and a vertical guide rail are formed on the side wall of the sliding column, the mounting groove is communicated with the vertical guide rail through the rotation guide slot, and a limiting end face is provided on the top of the vertical guide rail.

Further, the atomization assembly includes an ultrasonic atomization sheet and a sealing seat for fixing the ultrasonic atomization sheet; the atomization assembly also includes a conductive ring outside the sealing seat; one pole of the ultrasonic atomization sheet abuts against an elastic electrode and is electrically connected to one pole of a power supply through the elastic electrode; a lead passing through the sealing seat and in pressing contact with the conductive ring is welded to the other pole of the ultrasonic atomization sheet, a buckling groove corresponding to the buckling portion is formed on a side wall of the conductive ring, and the slider is welded with a lead and is electrically connected to the other pole of the power supply.

Further, a cartridge is also provided in the groove at the top of the sliding column, an upper cover assembly and a top cover assembly are provided on the top of the housing, the sliding column can move along the length of the electronic cigarette, the cartridge is disposed in the groove at the top of the sliding column, an atomization surface of the ultrasonic atomization sheet is in contact with the cartridge, the top cover assembly includes a suction nozzle and a top cover, the upper cover assembly is provided with a guide slot for guiding the top cover assembly to be opened, the top cover has a guide portion cooperating with the guide slot, and the sliding column has a limiting portion for limiting the top cover; and when the top cover assembly is not opened, the limiting portion abuts against an end face of the top cover.

The sliding column is pressed down to drive the cartridge to move down together, and the limiting portion can be separated from the top cover, so that the limiting portion loses the limiting effect on the top cover. The guide portion can slide along the guide slot and push the top cover, so that the top cover assembly can be opened, and the cartridge is exposed and replaced. Compared with the manner of manually pulling or unscrewing the cover in the prior art, the operation of the present invention is simple and convenient.

Further, a fifth springs is also provided in the guide slot, two fifth springs are symmetrically disposed on two sides of the suction nozzle, one end of the fifth spring abuts against the upper cover assembly, and the other end of the fifth spring abuts against the guide portion; each fifth spring is on one side of the corresponding guide portion, and the limiting portion is on the other side of the guide portion; and when the top cover assembly is not opened, the fifth springs are in a compressed state.

The sliding column is pressed down to separate the limiting portion from the top cover, so that the limiting portion loses the limiting effect on the top cover. The guide portion slides along the guide slot under the restoring force of the fifth spring and pushes the top cover, the top cover assembly is automatically opened, and the cartridge is exposed and replaced. Compared with the manner of manually pulling or unscrewing the cover in the prior art, the top cover assembly can be automatically opened only by pressing the sliding column in the present invention, so that the cartridge is exposed for replacement, so the operation is simple and convenient; and the top cover or the top cover assembly does not need to be detached, which can prevent the loss of parts after the top cover is detached.

As a preferred mode, a cartridge is also provided in the groove at the top of the sliding column, a suction nozzle is provided at the top of the housing, and the suction nozzle, the cartridge and the atomization assembly are connected into a whole.

The atomization assembly, the cartridge and the suction nozzle can be replaced as a whole, which is more convenient.

As a preferred mode, a cartridge is also provided in the groove at the top of the sliding column, a suction nozzle is provided at the top of the housing, the atomization assembly includes an ultrasonic atomization sheet and a conductive ring outside the ultrasonic atomization sheet, the cartridge is disposed in the suction nozzle, a sealing seat is disposed between the cartridge and the suction nozzle, and the cartridge, the sealing seat and the suction nozzle are connected into a whole; a buckling groove corresponding to the buckling portion is formed on a side wall of the suction nozzle; one pole of the ultrasonic atomization sheet abuts against an elastic electrode and is electrically connected to one pole of a power supply through the elastic electrode; a lead in pressing contact with the conductive ring is welded to the other pole of the ultrasonic atomization sheet, and the slider is welded with a lead and is electrically connected to the other pole of the power supply; and when the buckling portion locks the buckling groove, the suction nozzle abuts against the conductive ring.

The atomization assembly and the cartridge are two independent parts, and can be replaced separately, so that the use cost can be reduced and the assembly is more convenient and faster.

Further, a switch key for controlling the connection or disconnection of an operating circuit of the electronic cigarette is also disposed in the housing, and the electronic cigarette also includes a limiting mechanism capable of preventing a large key from moving inward when the sliding column moves down.

With the above structure, the sliding column is pressed down to drive the cartridge to move down together, and the limiting portion can be separated from the top cover, so that the limiting portion loses the limiting effect on the top cover. The guide portion can slide along the guide slot and push the top cover, so that the top cover assembly can be opened, and the cartridge is exposed and replaced. Compared with the manner of manually pulling or unscrewing the cover in the prior art, the operation of the present invention is simple and convenient. At the same time, when the sliding column is pressed down, the limiting mechanism can prevent the large key from moving inward, which can prevent the large key from being touched by mistake during the replacement of the cartridge, avoid dry burning of the electronic cigarette, and ensure the service life of the electronic cigarette.

As a preferred mode, the limiting mechanism includes a limiting boss provided on the sliding column and capable of abutting against an inner side face of the large key when the sliding column moves down.

Further, when the top cover assembly is locked, a top surface of the large key and a bottom surface of the limiting boss are on the same plane but are not in contact with each other; and when the large key is pressed, the top surface of the large key abuts against the bottom surface of the limiting boss.

With the above structure, when the large key is pressed to start the electronic cigarette, the sliding column is limited by the large key and cannot move down, thereby preventing the cartridge from falling off due to accidental touch during smoking, and improving the smoking experience of the electronic cigarette.

Further, a vertical limiting slot matching the limiting boss is provided in the top of the inner side face of the large key.

The vertical limiting slot matching the limiting boss is provided inside the large key, which improves the operation hand feel.

Further, a hidden slot is provided at a position on the sliding column corresponding to the limiting boss, and the top of the large key extends into the hidden slot.

Further, an air outlet channel communicated with the suction nozzle is also formed inside the housing, and the top cover assembly also includes a tapered seal ring fixed in the suction nozzle; and when the top cover assembly is not opened, a small end of the tapered seal ring extends into the air outlet channel, the top of a side wall of the air outlet channel abuts against an outer wall of the tapered seal ring, and the tapered seal ring connects the air outlet channel with the suction nozzle.

With the above structure, since the tapered seal ring is disposed between the suction nozzle and the air outlet channel, when the top cover assembly is mounted, the small end of the tapered seal ring extends into the air outlet channel and abuts against the side wall of the air outlet channel, the alignment of the suction nozzle and the air outlet channel can be automatically calibrated through the small end of the tapered seal ring, at the same time, the sealing performance at the connection between the suction nozzle and the air outlet channel is good, smoke leakage can be prevented, and the user experience is good.

Further, the top cover assembly can slide relative to the air outlet channel to open a top opening of the housing.

The top cover assembly slides relative to the air outlet channel to open the top opening of the housing, which facilitates replacing parts or cleaning the air outlet channel.

Further, the top cover assembly also includes an adjusting spring and a step shaft in the suction nozzle, an adjusting slot is formed on an inner side wall of the step shaft, a large end of the tapered seal ring is disposed in the adjusting slot and can move within the adjusting slot, a top end of the adjusting spring abuts against a top surface of the adjusting slot, and a bottom end of the adjusting spring abuts against the large end of the tapered seal ring.

With the above structure, when the top cover assembly slides relative to the air outlet channel, the small end of the tapered seal ring is squeezed by the top of the air outlet channel, and the tapered seal ring moves toward the suction nozzle, so that the adjusting spring is compressed and deformed. In this process, friction force is generated between the outer side wall of the small end of the tapered seal ring and the top of the air outlet channel, and between the outer bottom end face of the small end of the tapered seal ring and the top of the air outlet channel, which can increase the sliding hand feel. In the process of closing the cover, when the tapered seal ring of the top cover assembly slides to align with the air outlet channel, the small end of the tapered seal ring is automatically inserted into the air outlet channel under the restoring force of the adjusting spring, and the outer wall of the tapered seal ring and the inner wall of the air outlet channel form a sealed body to prevent smoke from leaking there to affect the smoking effect.

Compared with the prior art, the present invention has the advantages that the atomization assembly can be ejected for replacement without contacting the atomization assembly by hand, thereby preventing scalding and staining the hand; the top cover assembly can be automatically opened only by pressing the sliding assembly to replace the cartridge; the top cover assembly can be reset by pushing to avoid misalignment; the two operations of replacing the cartridge and pressing the large key cannot be performed simultaneously, which prevents dry burning of the atomization assembly caused by accidentally touching the large key; the alignment of the suction nozzle and the air outlet channel can be automatically corrected by the top cover assembly, so that the sealing performance at the connection between the suction nozzle and the air outlet channel is good, and smoke leakage is prevented; and the electronic cigarette is simple to operate, convenient, fast, and good in user experience.

Figure 1:
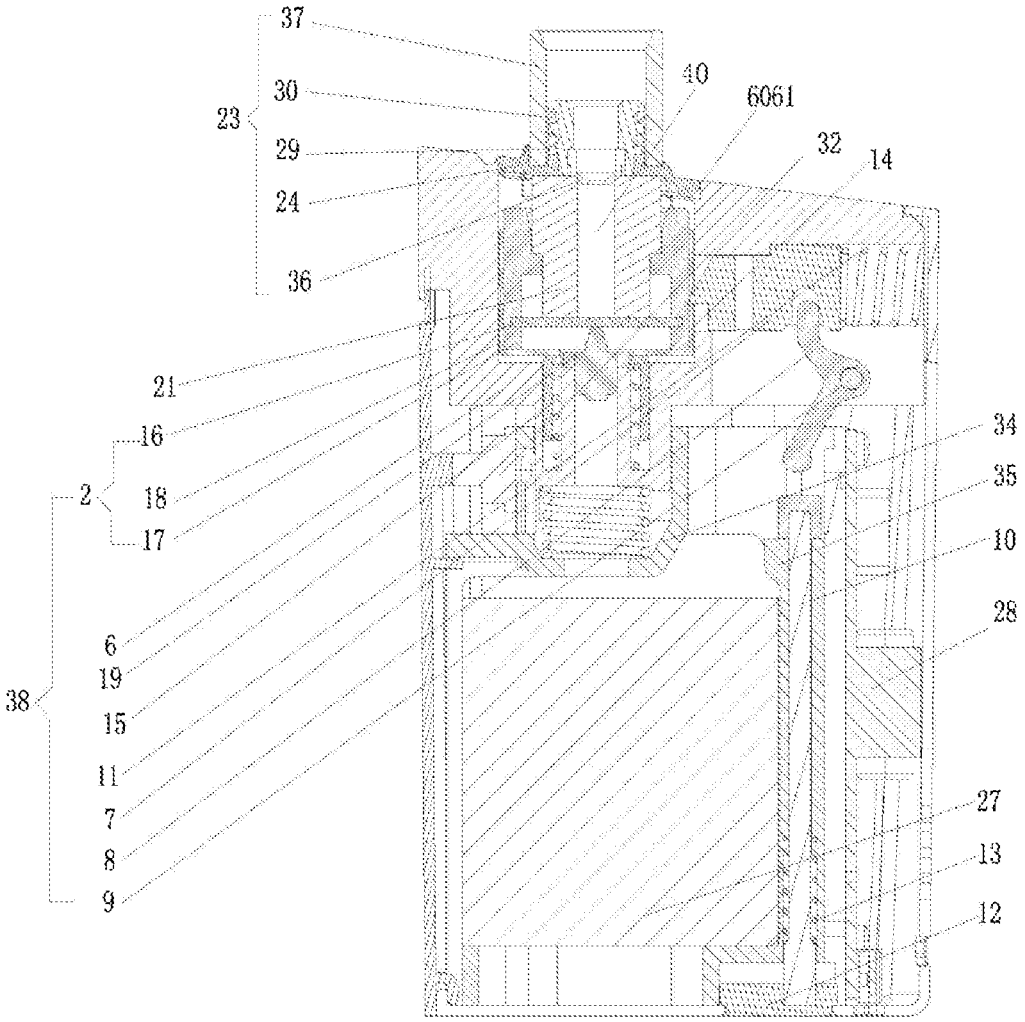
FIG. 1 is a front cross-sectional view of a first embodiment of the present invention.
Figure 2:
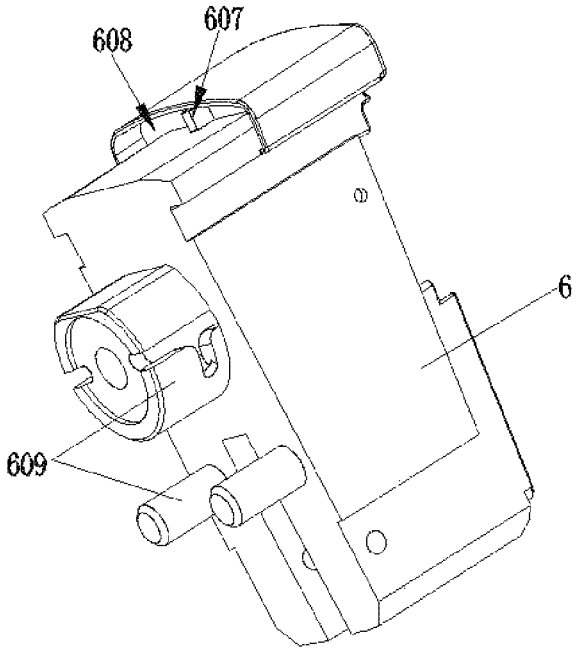
FIG. 2 is a structural diagram of a sliding column.
Figure 3:
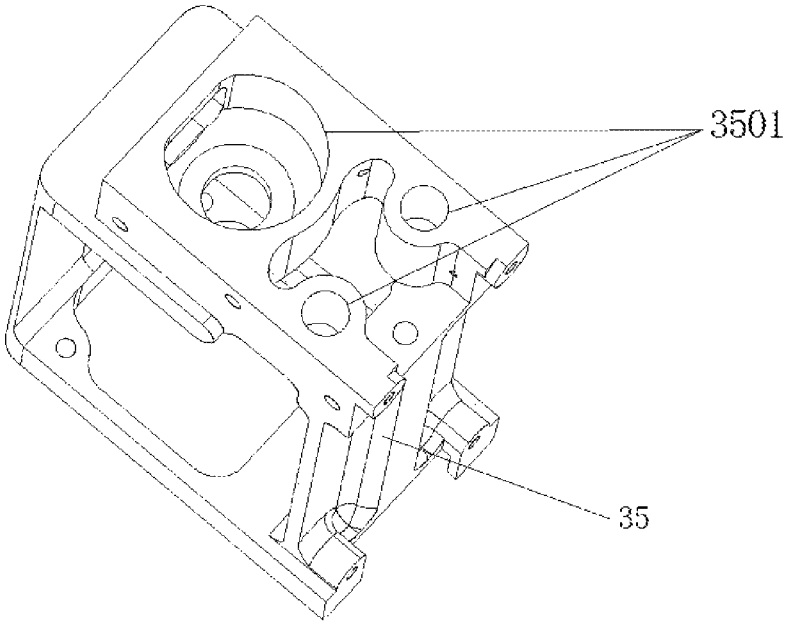
FIG. 3 is a structural diagram of a support.
Figure 4:
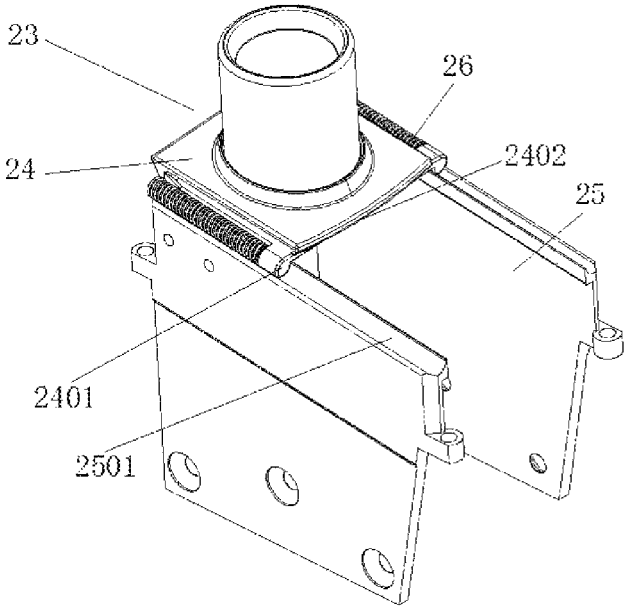
FIG. 4 is a schematic diagram of a mounting structure of a top cover assembly and a guide plate.
Figure 5:
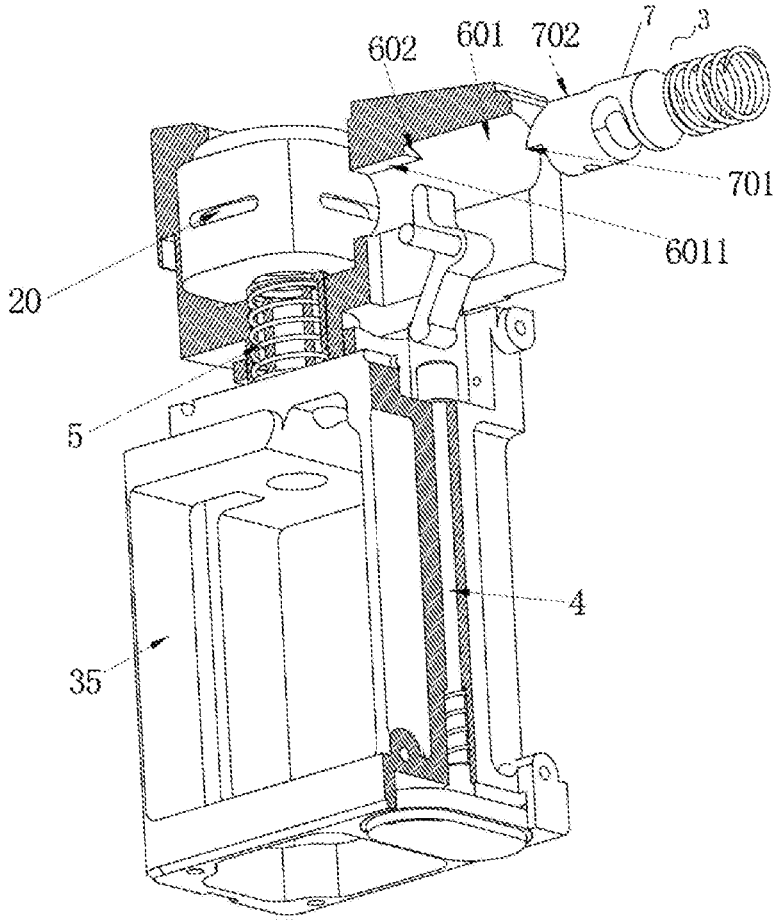
FIG. 5 is a schematic diagram of an internal structure of the first embodiment of the present invention.
Figure 6:
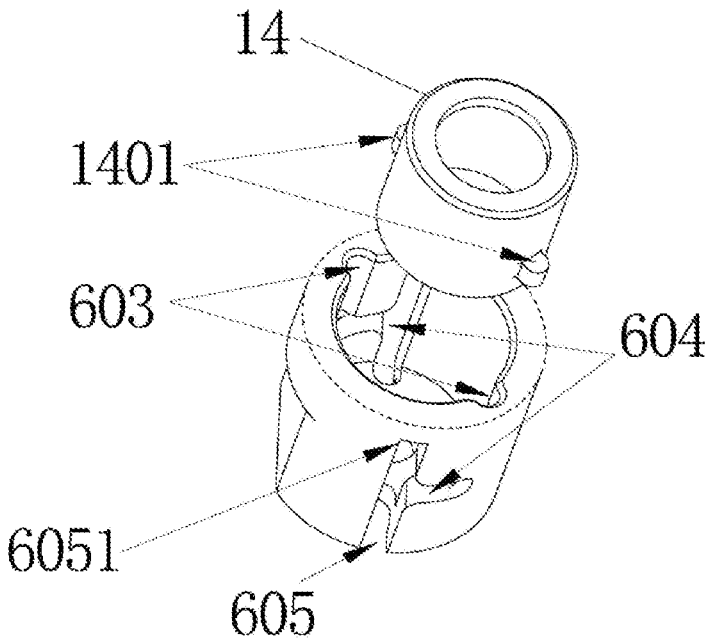
FIG. 6 is a schematic diagram of a connection structure of a top column and the sliding column.
Figure 7:
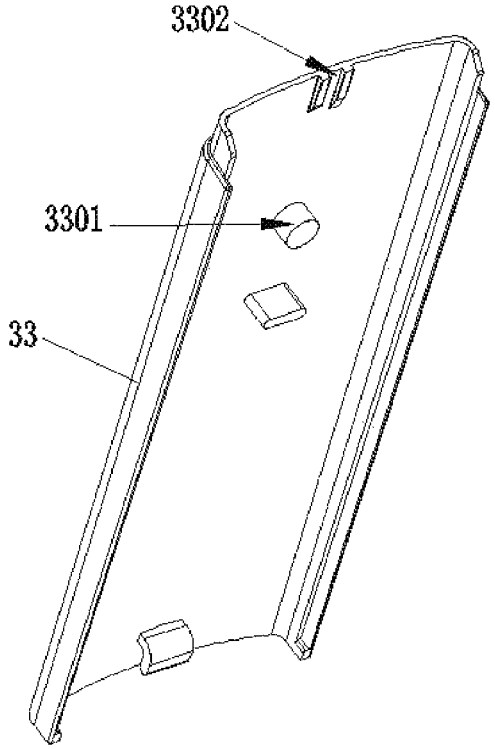
FIG. 7 is a schematic structural diagram of a large key.
Figure 8:
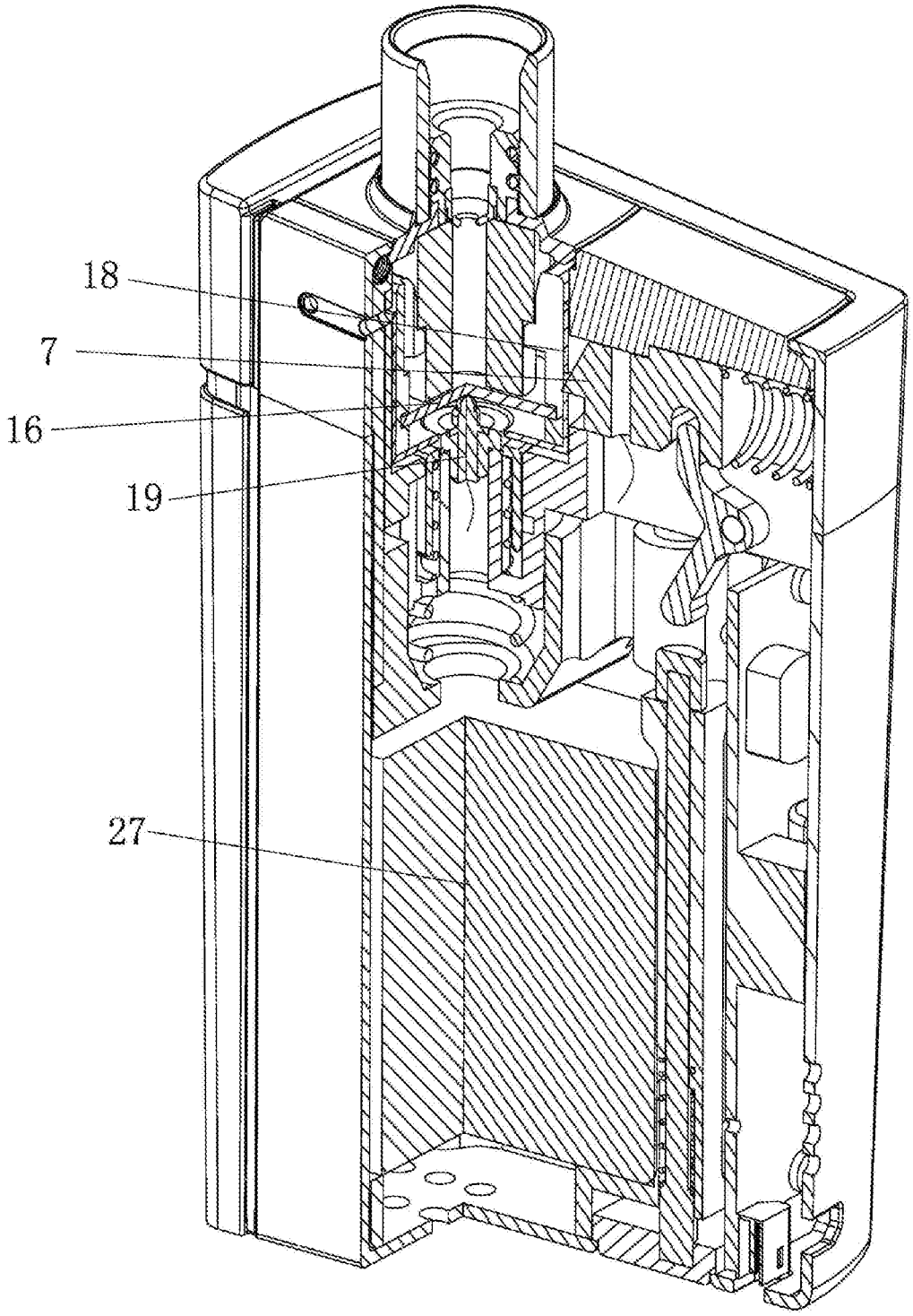
FIG. 8 is a schematic diagram of a circuit structure of the first embodiment of the present invention.
Figure 9:
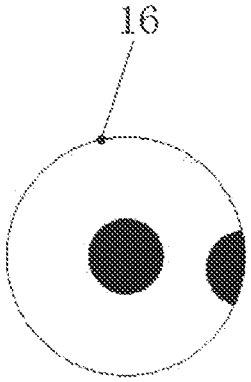
FIG. 9 is a schematic structural diagram of an ultrasonic atomization sheet.
Figure 10:
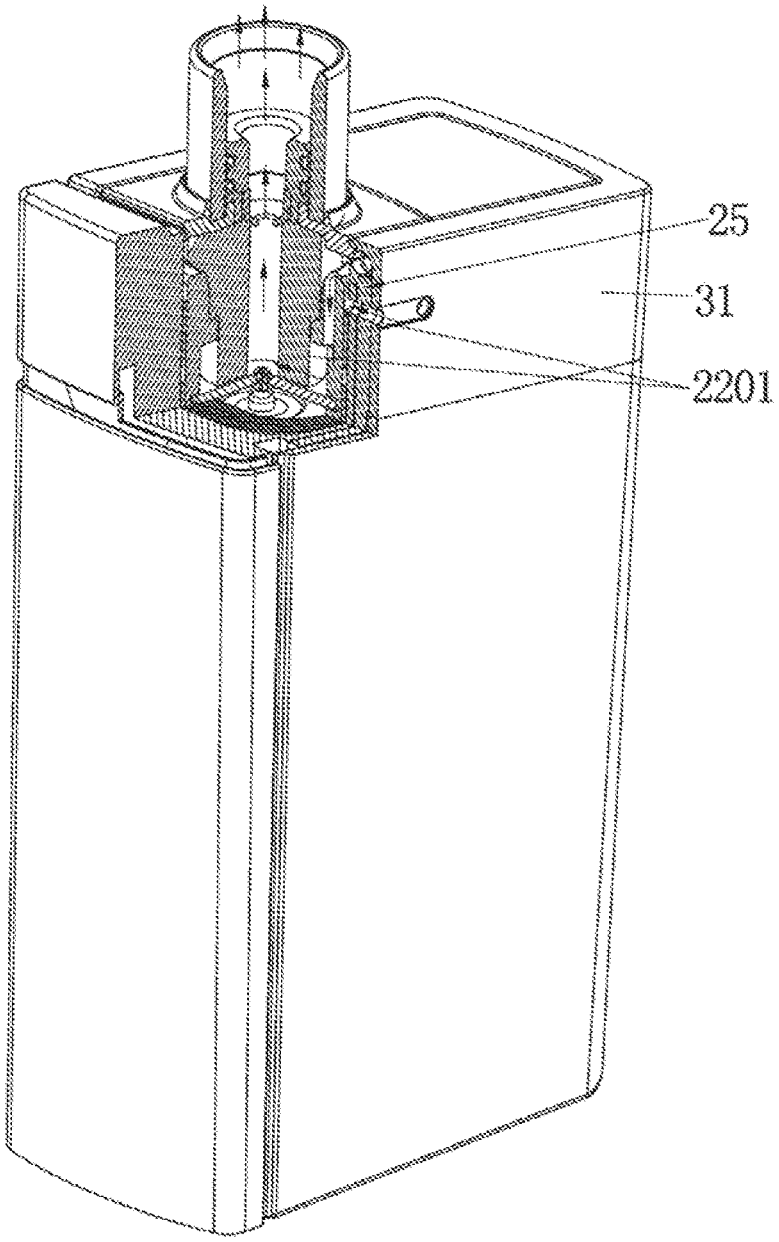
FIG. 10 is an air channel diagram of the first embodiment of the present invention.
Figure 11:
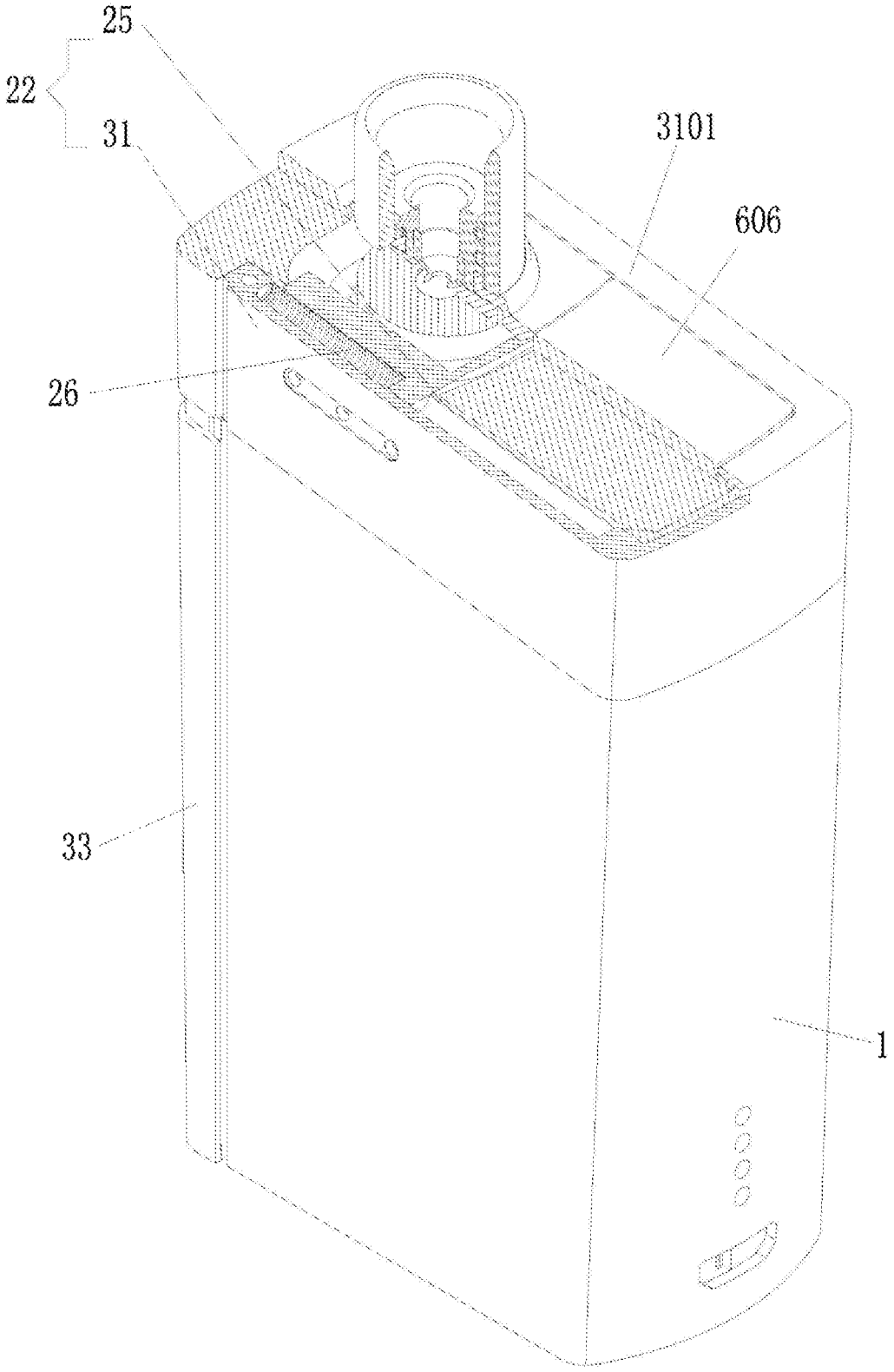
FIG. 11 is a structural diagram of the first embodiment of the present invention when the sliding column is not pressed down.
Figure 12:
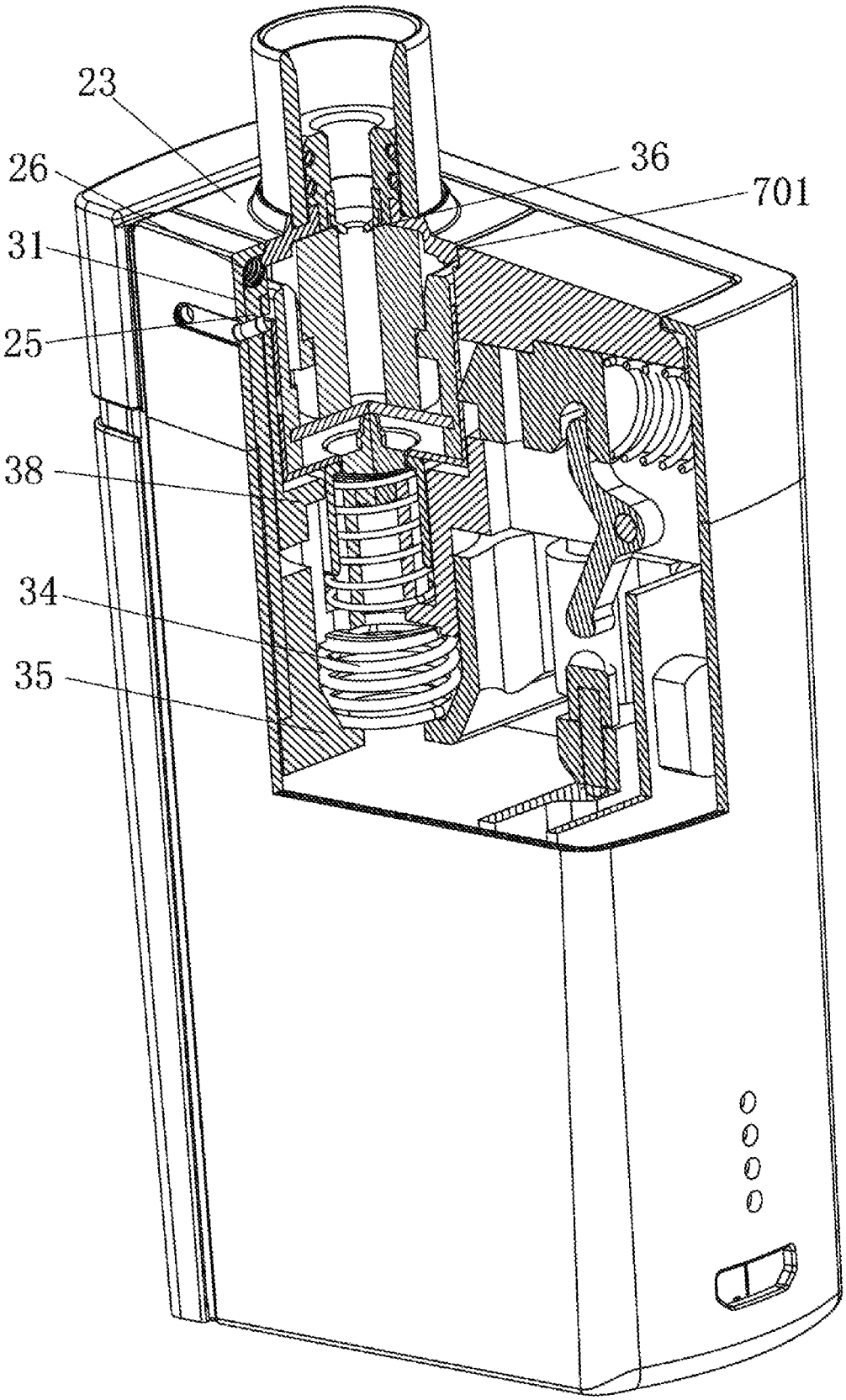
FIG. 12 is a partial cross-sectional view of FIG. 11.
Figure 13:
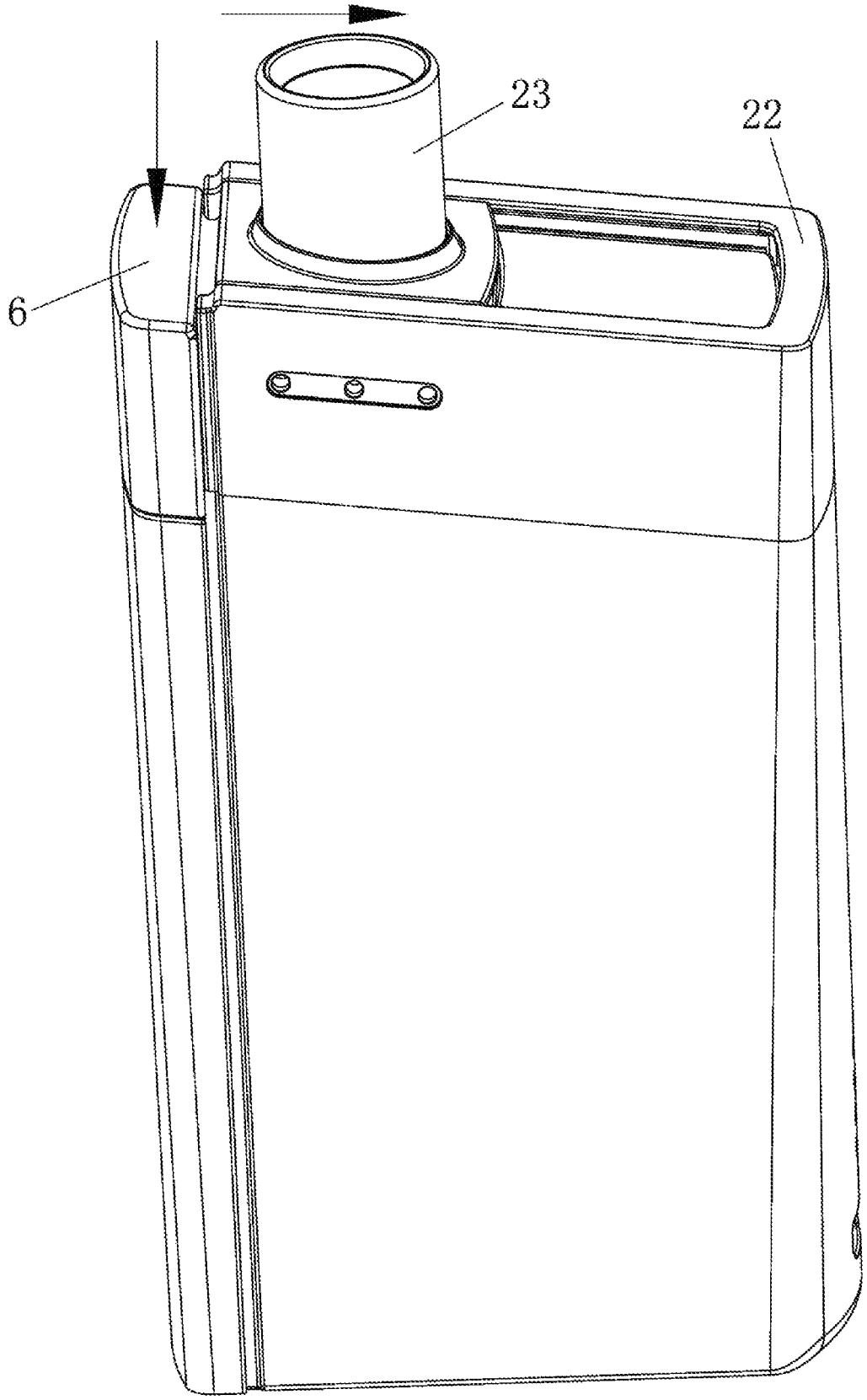
FIG. 13 is a structural diagram of the first embodiment of the present invention at the moment when the sliding column is pressed down.
Figure 14:
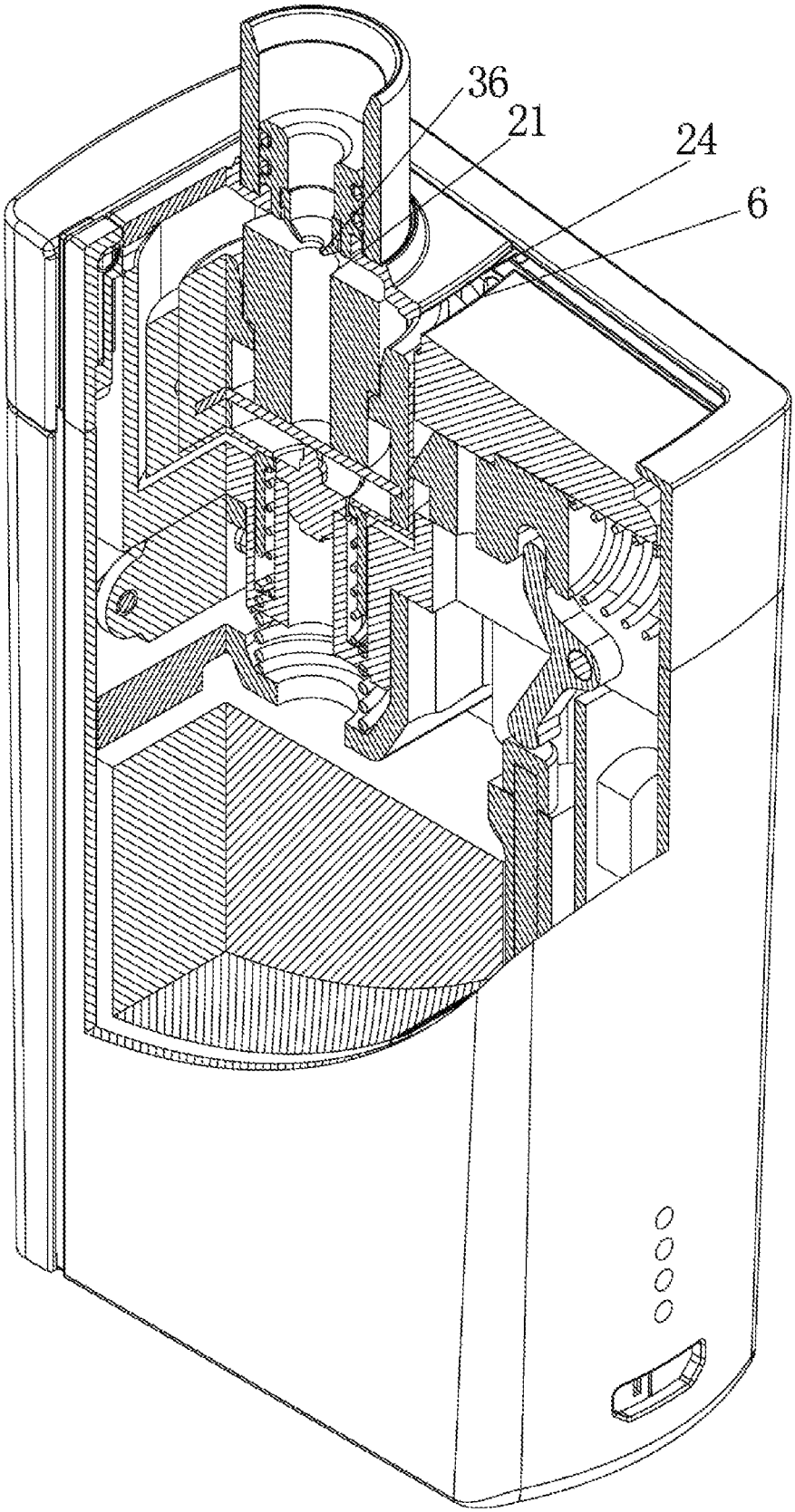
FIG. 14 is a partial cross-sectional view of FIG. 13.
Figure 15:
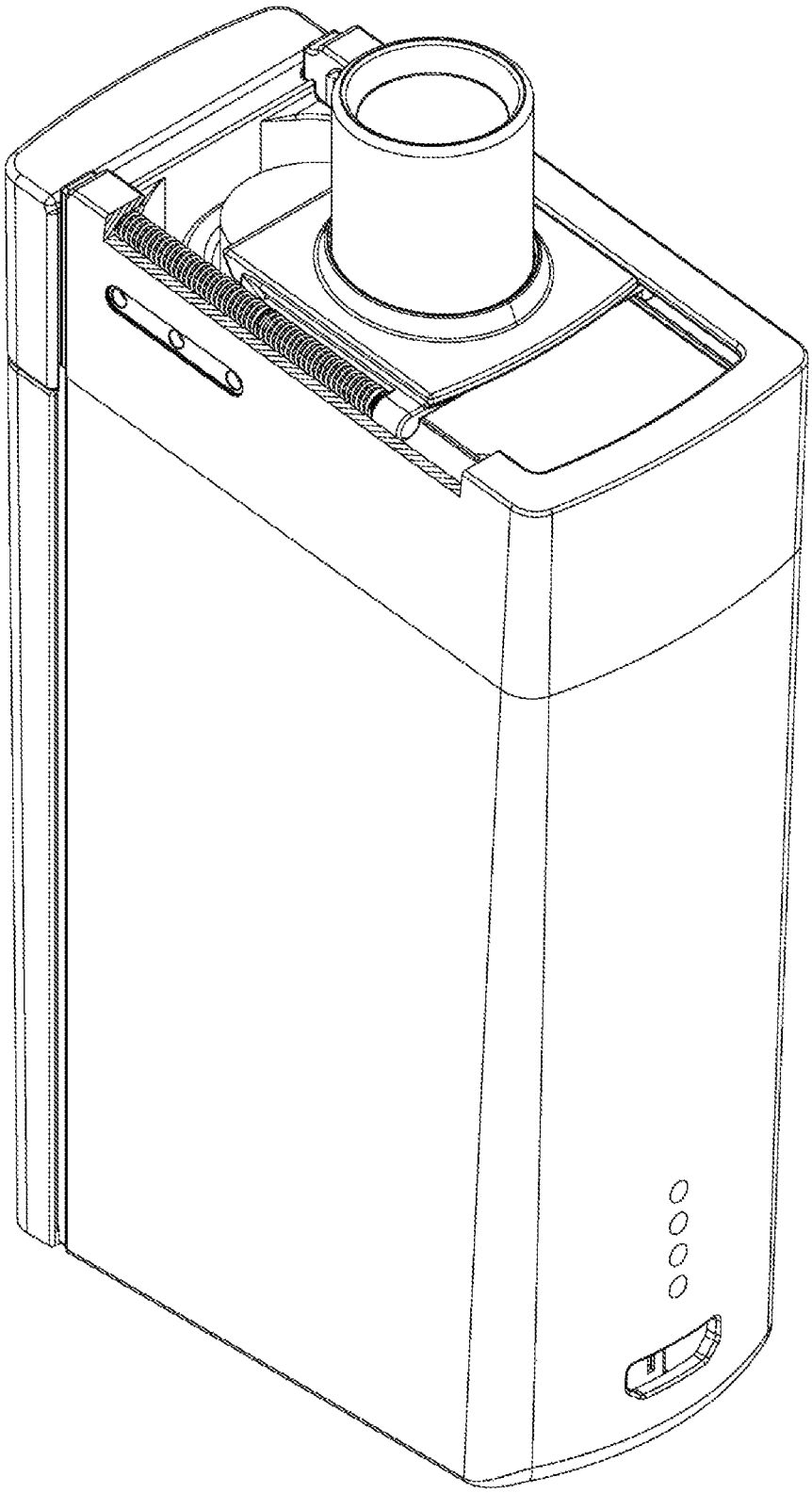
FIG. 15 is a schematic structural diagram of the first embodiment of the present invention in the unlocking process of the top cover assembly.
Figure 16:
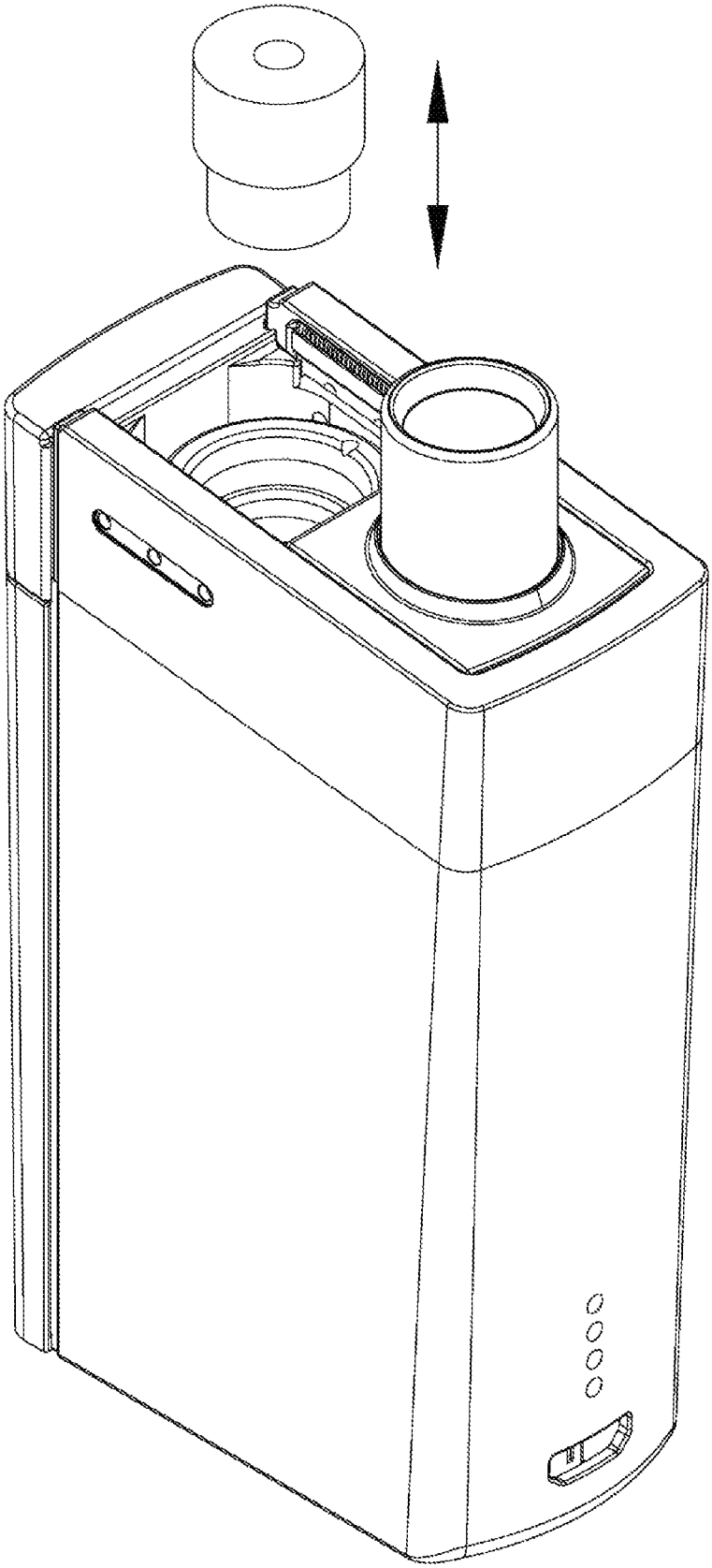
FIG. 16 is a schematic structural diagram when the top cover assembly is fully opened to replace the cartridge.

In which: 1 housing, 2 atomization assembly, 3 fixing mechanism, 4 unlocking mechanism, 5 elastic mechanism, 6 sliding column, 601 receiving hole, 6011 first plane, 602 limiting step, 603 mounting groove, 604 rotation guide slot, 605 vertical guide rail, 6051 limiting end face, 606 limiting portion, 6061 hook, 607 limiting mechanism, 608 hidden slot, 609 cylindrical portion, 7 slider, 701 buckling portion, 702 second plane, 8 rotating tongue, 9 rotating shaft, 10 ejector rod, 11 second spring, 12 key block, 13 fourth spring, 14 top column, 1401 lug, 15 first spring, 16 ultrasonic atomization sheet, 17 sealing seat, 18 conductive ring, 19 elastic electrode, 20 buckling groove, 21 cartridge, 22 upper cover assembly, 2201 air inlet hole, 23 top cover assembly, 24 top cover, 2401 guide portion, 2402 clamping slot, 25 guide plate, 2501 guide slot, 26 fifth spring, 27 battery, 28 main board, 29 step shaft, 30 nozzle seal ring, 31 upper cover, 3101 flange portion, 32 switch key, 33 large key, 3301 pressing portion, 3302 vertical limiting slot, 34 third spring, 35 support, 3501 cylindrical hole, 36 tapered seal ring, 37 suction nozzle, 38 sliding assembly, 40 air outlet channel, 41 adjusting spring, 42 air outlet tube.

DETAILED DESCRIPTION OF EMBODIMENTS

Embodiment 1

As shown in FIG. 1 to FIG. 10, an electronic cigarette includes a housing 1, an atomization assembly 2 is disposed in the housing 1, and the electronic cigarette also includes a fixing mechanism 3 capable of fixing the atomization assembly 2, an unlocking mechanism 4 for controlling the fixing mechanism 3 to be relatively fixed to or separated from the atomization assembly 2, and an elastic mechanism 5 for ejecting the atomization assembly 2 outward when the fixing mechanism 3 is separated from the atomization assembly 2.

When the atomization assembly 2 is replaced, the unlocking mechanism 4 controls the fixing mechanism 3 to be separated from the atomization assembly 2, and the elastic mechanism 5 immediately ejects the atomization assembly 2 outward, so that the atomization assembly 2 can be ejected for replacement without contacting the atomization assembly 2 by hand, the hand is prevented from being scalded and stained, and the operation is simple, practical and convenient.

The electronic cigarette also includes a sliding column 6 at the top of the housing 1, the atomization assembly 2 is disposed in a groove on the top of the sliding column 6, the fixing mechanism 3 includes a slider 7 disposed in a receiving hole 601 of the sliding column 6 and movable perpendicular to the length of the electronic cigarette, and a buckling portion 701 capable of fixing the atomization assembly 2 is provided at the end of the slider 7 close to the atomization assembly 2.

The unlocking mechanism 4 includes a rotating tongue 8, a rotating shaft 9 and an ejector rod 10 in the housing 1, the ejector rod 10 is movable along the length of the electronic cigarette, the middle of the rotating tongue 8 is connected to the sliding column 6 through the rotating shaft 9, the rotating tongue 8 can rotate around the rotating shaft 9, one end of the rotating tongue 8 extends into a groove at the bottom of the slider 7, the other end of the rotating tongue 8 is opposite to a top end of the ejector rod 10, and the top end of the ejector rod 10 can push the rotating tongue 8 to rotate and drive the slider 7 through the rotating tongue 8 to be separated from the atomization assembly 2.

When the atomization assembly 2 needs to be replaced, the ejector rod 10 is pushed upward, the ejector rod 10 lifts the rotating tongue 8, then the rotating tongue 8 rotates around the rotating shaft 9, so that the slider 7 slides with the rotation of the rotating tongue 8, the atomization assembly 2 is released from the fixing effect of the buckling portion 701 on the slider 7, the atomization assembly 2 is ejected by the elastic mechanism 5, and the atomization assembly 2 can be replaced.

The fixing mechanism 3 also includes a second spring 11, one end of the second spring 11 abuts against the end of the slider 7 away from the atomization assembly 2, and the other end of the second spring 11 abuts against the inner side wall of the housing 1.

The slider 7 can be quickly reset by the second spring 11.

The unlocking mechanism 4 also includes a key block 12 disposed at the bottom of the housing 1 and capable of pushing the ejector rod 10 to move.

A fourth spring 13 for controlling the ejector rod 10 to reset is sleeved outside the ejector rod 10.

The ejector rod 10 can be quickly reset by the fourth spring 13.

The sliding column 6 is provided with a limiting step 602 opposite to the second spring 11 for limiting the slider 7.

A first plane 6011 is provided on an inner side wall of the receiving hole 601 to prevent the slider 7 from rotating, and a second plane 702 corresponding to the first plane 6011 is provided on the slider 7. The elastic mechanism 5 includes a top column 14 and a first spring 15 both disposed in a groove at the bottom of the sliding column 6, and the first spring 15 abuts between the sliding column 6 and the top column 14.

A lug 1401 is provided on the outer side wall of the top column 14, a mounting groove 603 corresponding to the lug 1401 is formed on the side wall of the sliding column 6, a rotation guide slot 604 and a vertical guide rail 605 is formed on the side wall of the sliding column 6, the mounting groove 603 is communicated with the vertical guide rail 605 through the rotation guide slot 604, and a limiting end face 6051 is provided on the top of the vertical guide rail 605.

The atomization assembly 2 includes an ultrasonic atomization sheet 16 and a sealing seat 17 for fixing the ultrasonic atomization sheet 16; the atomization assembly 2 also includes a conductive ring 18 outside the sealing seat 17; one pole of the ultrasonic atomization sheet 16 abuts against an elastic electrode 19 and is electrically connected to one pole of a power supply through the elastic electrode 19; a lead passing through the sealing seat 17 and in pressing contact with the conductive ring 18 is welded to the other pole of the ultrasonic atomization sheet 16, a buckling groove 20 corresponding to the buckling portion 701 is formed in the side wall of the conductive ring 18, and the slider 7 is welded with a lead and electrically connected to the other pole of the power supply.

A cartridge 21 is also provided in the groove at the top of the sliding column 6, an upper cover assembly 22 and a top cover assembly 23 are provided on the top of the housing 1, the sliding column 6 can move along the length of the electronic cigarette, the cartridge 21 is disposed in the groove at the top of the sliding column 6, an atomization surface of the ultrasonic atomization sheet 16 is in contact with the cartridge 21, the top cover assembly 23 includes a suction nozzle 37 and a top cover 24, the upper cover assembly 22 is provided with a guide slot 2501 for guiding the top cover assembly 23 to be opened, the top cover 24 has a guide portion 2401 cooperating with the guide slot 2501, and the sliding column 6 has a limiting portion 606 for limiting the top cover 24; and when the top cover assembly 23 is not opened, the limiting portion 606 abuts against an end face of the top cover 24.

The sliding column 6 is pressed down to drive the cartridge 21 to move down together, and the limiting portion 606 can be separated from the top cover 24, so that the limiting portion 606 loses the limiting effect on the top cover 24. The guide portion 2401 can slide along the guide slot 2501 and push the top cover 24, so that the top cover assembly 23 can be opened, and the cartridge 21 is exposed and replaced. Compared with the manner of manually pulling or unscrewing the cover in the prior art, the operation of the present invention is simple and convenient.

A fifth spring 26 is also provided in the guide slot 2501, two fifth springs 26 are symmetrically disposed on two sides of the suction nozzle 37, one end of the fifth spring 26 abuts against the upper cover assembly 22, and the other end of the fifth spring 26 abuts against the guide portion 2401; each of the two fifth springs 26 is on one side of the corresponding guide portion 2401, and the limiting portion 606 is on the other side of the guide portion 2401; and when the top cover assembly 23 is not opened, the fifth spring 26 is in a compressed state.

The sliding column 6 is pressed down to separate the limiting portion 606 from the top cover 24, so that the limiting portion 606 loses the limiting effect on the top cover 24. The guide portion 2401 slides along the guide slot 2501 under the restoring force of the fifth spring 26 and pushes the top cover 24, the top cover assembly 23 is automatically opened, and the cartridge 21 is exposed and replaced. Compared with the manner of manually pulling or unscrewing the cover in the prior art, the top cover assembly 23 can be automatically opened only by pressing the sliding column 6 in the present invention, and the cartridge 21 is exposed for replacement, so the operation is simple and convenient; and the top cover 24 or the top cover assembly 23 does not need to be detached, which can prevent the loss of parts after the top cover 24 is detached.

A battery 27 and a main board 28 are also disposed in the housing 1.

The top cover assembly 23 also includes a step shaft 29 disposed in the suction nozzle 37, and a nozzle seal ring 30 between the step shaft 29 and the suction nozzle 37.

The upper cover assembly 22 includes a guide plate 25, and the guide slot 2501 is formed in the top surface of the guide plate 25.

The upper cover assembly 22 also includes an upper cover 31, the upper cover 31 is disposed outside the guide plate 25, a flange portion 3101 is provided at the top of the upper cover 31, and the guide portion 2401 and the guide slot 2501 are both below the flange portion 3101.

The upper cover assembly 22 is provided with an air inlet hole 2201 connecting the outside with the cartridge 21.

The upper cover assembly 22 is provided with an air inlet hole 2201, the atomization assembly 2 inside the upper cover assembly 22 is provided with an air passing hole, and the bottom of the cartridge 21 is made of breathable material, so air flows into the air passing hole of the atomization assembly 2 through the upper cover assembly 22, and smoke is brought to user's mouth through the bottom of the cartridge 21.

The present invention also includes a switch key 32 for controlling the connection or disconnection of the operating circuit of the electronic cigarette, a large key 33 is disposed on one side of the housing 1, a pressing portion 3301 on the inner side face of the large key 33 is opposite to the switch key 32, and the present invention also includes a limiting mechanism 607 capable of preventing the large key 33 from moving inward when the sliding column 6 moves down. When the sliding column 6 is pressed down, the limiting mechanism 607 can prevent the large key 33 from moving inward, which can prevent the large key 33 from being touched by mistake during the replacement of the cartridge 21, avoid dry burning of the electronic cigarette, and ensure the service life of the electronic cigarette. The top cover assembly 23 has a function of moving left and right, and a sliding assembly 38 has a function of moving up and down.

The limiting mechanism 607 includes a limiting boss provided on the sliding column 6 and capable of abutting against the inner side face of the large key 33 when the sliding column 6 moves down. When the top cover assembly 23 is locked, the top surface of the large key 33 and the bottom surface of the limiting boss are on the same plane but are not in contact with each other; and when the large key 33 is pressed, the top surface of the large key 33 abuts against the bottom surface of the limiting boss.

When the large key 33 is pressed to start the electronic cigarette, the sliding column 6 is limited by the large key 33 and cannot move down, thereby preventing the cartridge 21 from falling off due to accidental touch during smoking, and improving the smoking experience of the electronic cigarette. A vertical limiting slot 3302 matching the limiting boss is provided in the top of the inner side face of the large key 33.

The vertical limiting slot 3302 matching the limiting boss is provided inside the large key 33, which improves the operation hand feel.

The sliding column 6 is provided with a hidden slot 608 corresponding to the limiting boss, and the top of the large key 33 extends into the hidden slot 608.

The top cover 24 is provided with a clamping slot 2402, and the limiting portion 606 is provided with a hook 6061 matching the clamping slot 2402.

When the top cover assembly 23 is not opened, the top cover assembly 23 and the sliding column 6 can be fixed and locked reliably through the clamping and locking effect of the clamping slot 2402 and the hook 6061. After the cartridge 21 is replaced, the top cover 24 is pushed by hand to move along the guide slot 2501 to be reset, and the clamping slot 2402 is locked with the hook 6061, so that the misalignment is unlikely to occur, the time and labor are saved, and the user experience is good. A third spring 34 and a support 35 are disposed in the housing 1, the sliding column 6 is disposed on the support 35, one end of the third spring 34 abuts against the support 35, and the other end of the third spring 34 abuts against the outer bottom surface of the sliding column 6.

After the cartridge 21 is replaced, the top cover assembly 23 slides back to the original position by hand, then the sliding column 6 is released, the sliding assembly 38 is automatically bounced and reset under the action of the third spring 34, and the top cover assembly 23 is locked.

An air outlet channel 40 communicated with the suction nozzle 37 is also formed inside the housing 1, and a central hole of the cartridge 21 forms the air outlet channel 40.

The top cover assembly 23 also includes a tapered seal ring 36 fixed in the suction nozzle 37; and when the top cover assembly 23 is not opened, a small end of the tapered seal ring 36 extends into the air outlet channel 40 (that is, the central hole of the cartridge 21), the side wall of the air outlet channel 40 (that is, the top of the cartridge 21) abuts against the outer wall of the tapered seal ring 36, and the tapered seal ring 36 connects the air outlet channel 40 (that is, the central hole of the cartridge 21) with the suction nozzle 37. The top cover assembly 23 can slide relative to the air outlet channel 40 to open a top opening of the housing 1.

The tapered seal ring 36 is automatically aligned with the cartridge 21 having the central hole, so that an air channel is sealed perfectly.

The tapered seal ring 36 is made of elastic material. The elastic material is silica gel or flexible glue. The top cover assembly also includes an adjusting spring 41, a step shaft 29 in the suction nozzle 37, and a nozzle seal ring 30 between the step shaft 29 and the suction nozzle 37.

The support 35 is provided with a cylindrical hole 3501, the axis of the cylindrical hole 3501 is parallel to the length direction of the electronic cigarette, and the bottom of the sliding column 6 is provided with a cylindrical portion 609 capable of moving up and down within the cylindrical hole 3501.

There is a gap between the cylindrical portion 609 and the cylindrical hole 3501, so that the cylindrical portion 609 can move up and down within the cylindrical hole 3501, which ensures that the sliding assembly 38 does not deviate during movement, and the user experience is good.

As shown in FIG. 11 to FIG. 16, the top cover assembly 23 of the present invention has three operating states:

a. Cover use state: the top cover assembly 23 is provided with a tapered seal ring 36, and when the top cover 24 of the top cover assembly 23 abuts against the limiting portion 606 of the sliding column 6, since the third spring 34 always applies an upward elastic force to the sliding assembly 38, the clamping slot 2402 in the side of the top cover 24 is clamped and locked with the hook 6061 on the sliding column 6. When the user presses the large key 33 to the right, the switch key 32 is touched, and a user can smoke with the mouth opposite to the opening of the suction nozzle 37.

b. The top cover 24 begins unlocking: when the sliding column 6 is pressed down, the sliding assembly 38 sinks, the top cover 24 is misaligned with the limiting portion 606, and the top cover assembly 23 is free to begin unlocking.

c. Semi-unlocked state: because the fifth spring 26 always applies an elastic force to the right, when the sliding assembly 38 is pressed down and the top cover assembly 23 is released, the top cover 24 automatically slides to the right to open the cover.

d. Fully unlocked state: the top cover assembly 23 continuously moves to the right by the elastic force applied by the fifth spring 26 until the fully unlocked state, the top of the cartridge 21 is completely exposed, and the cartridge 21 can be replaced at this time.

Figure 17:
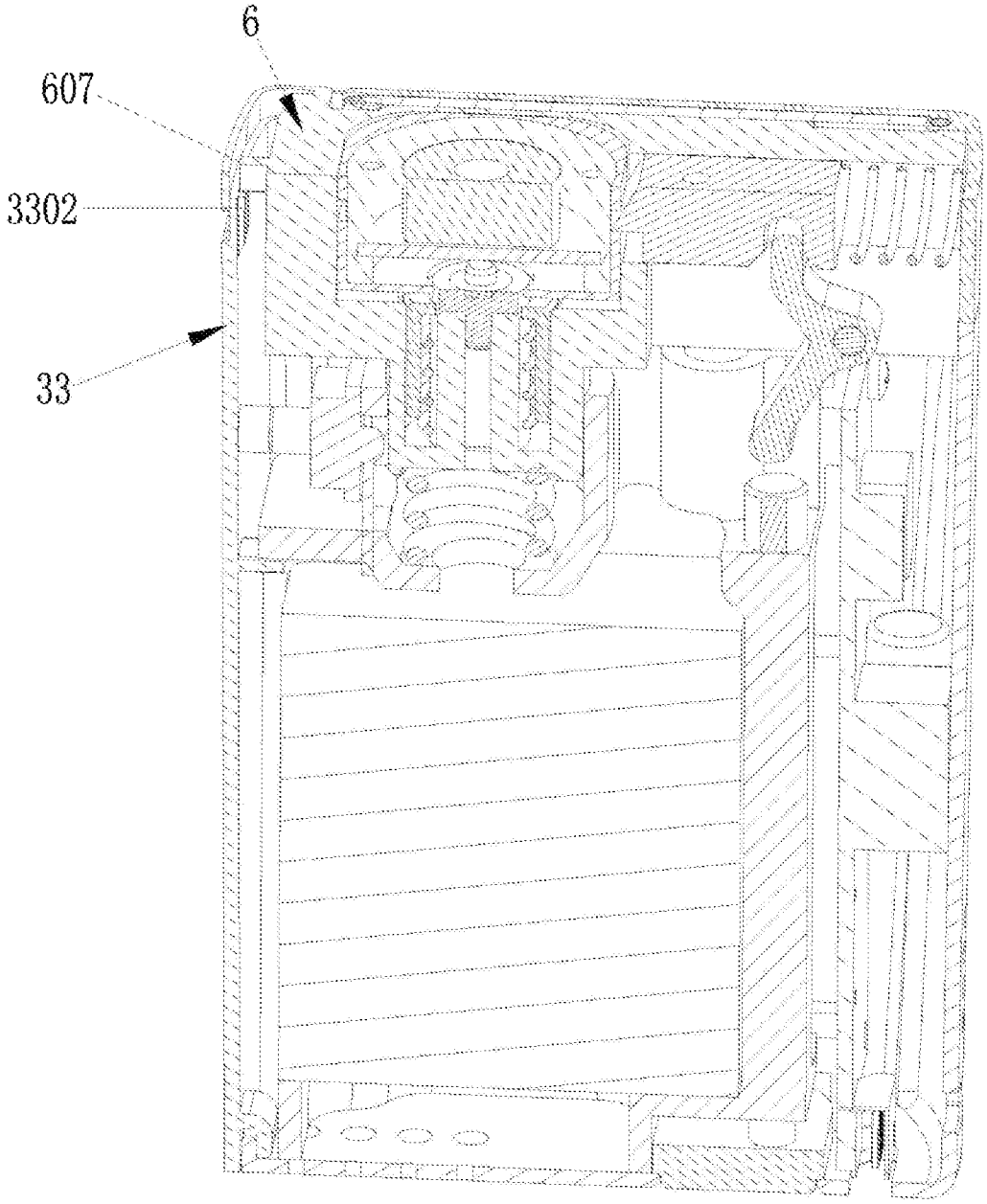
FIG. 17 is a schematic structural diagram of the first embodiment of the present invention when the sliding column and a large key are not pressed down.
Figure 18:
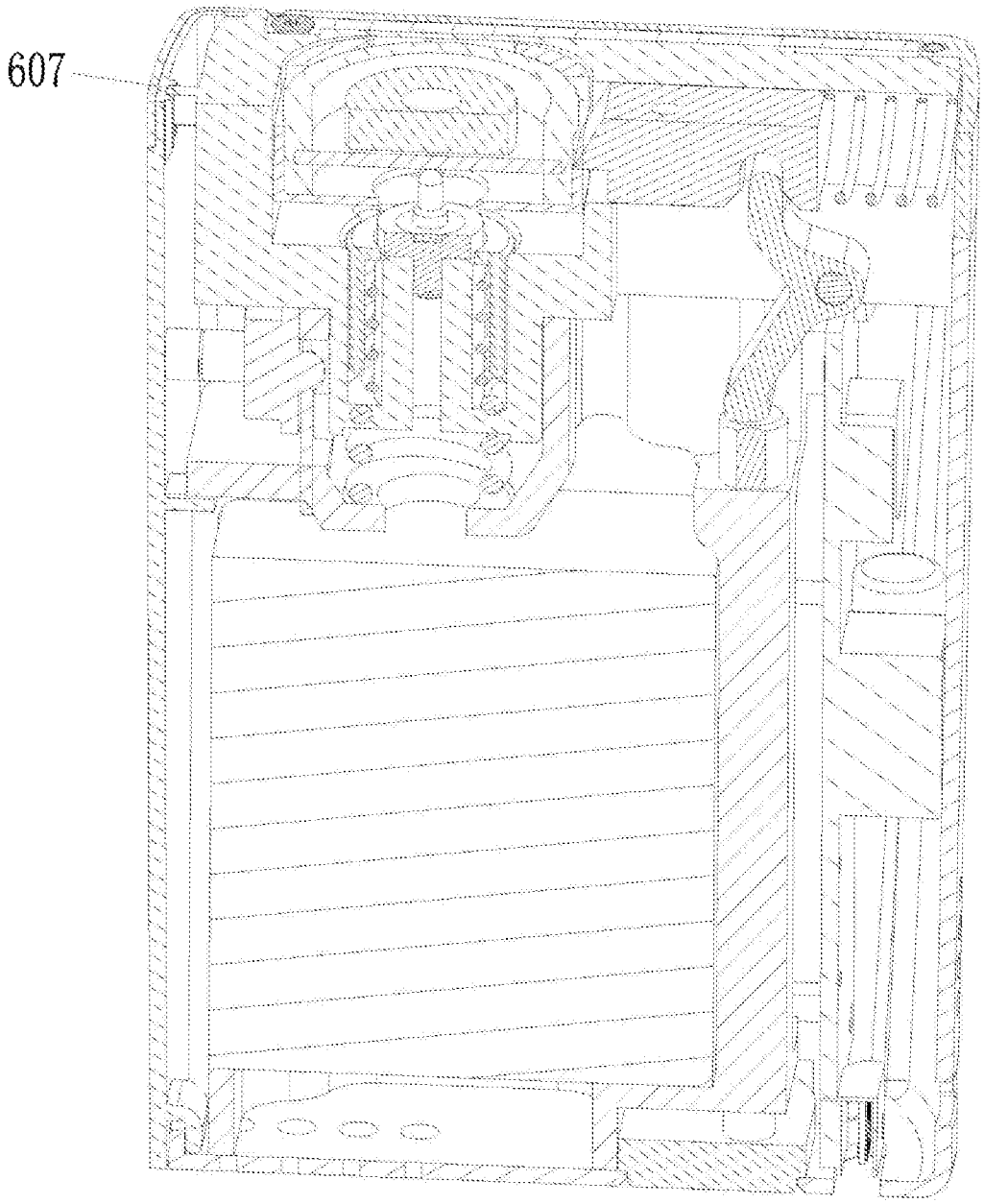
FIG. 18 is a schematic structural diagram of the first embodiment of the present invention when the sliding column is pressed down.
Figure 19:
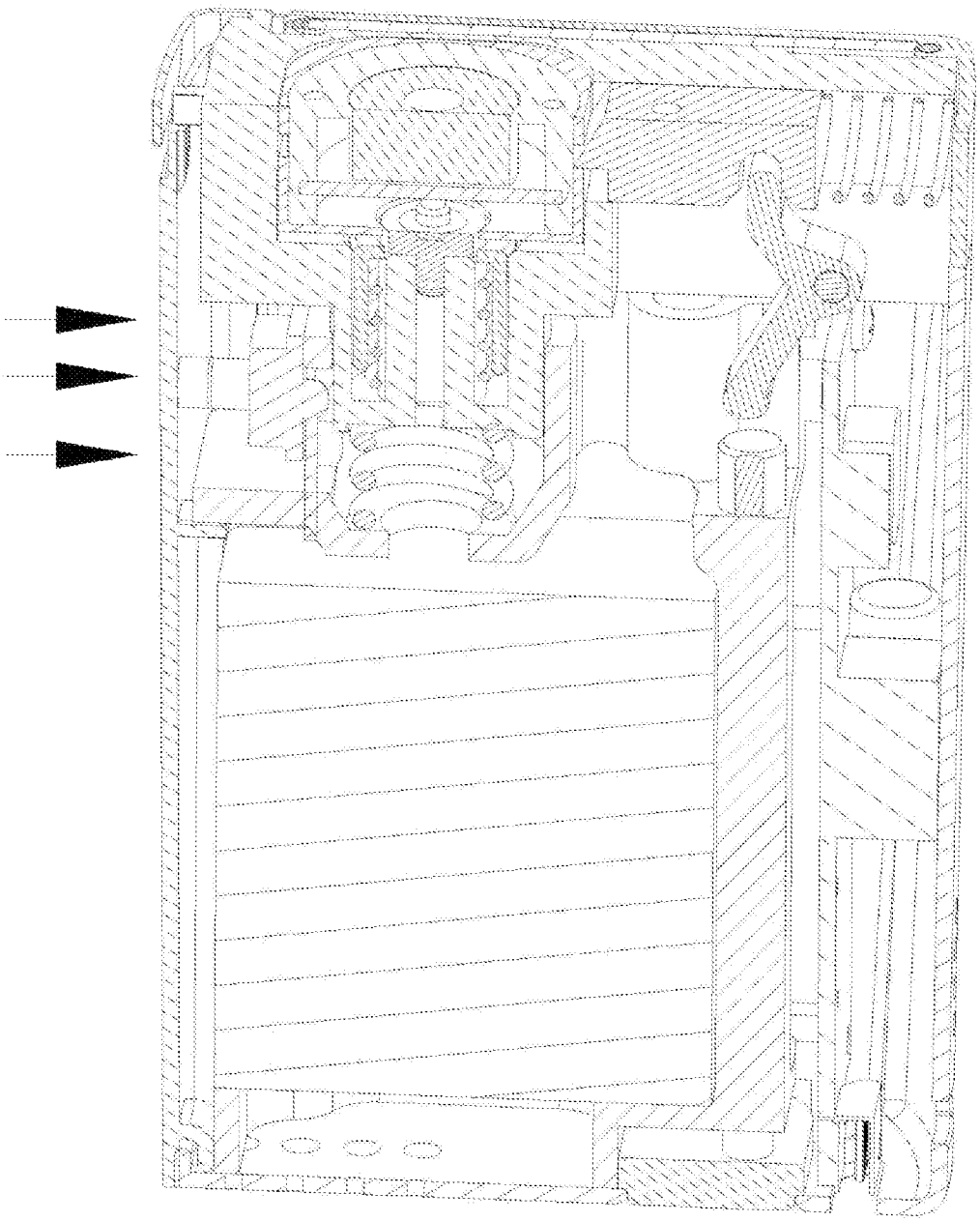
FIG. 19 is a schematic structural diagram of the first embodiment of the present invention when the large key is pressed down.
Figure 20:
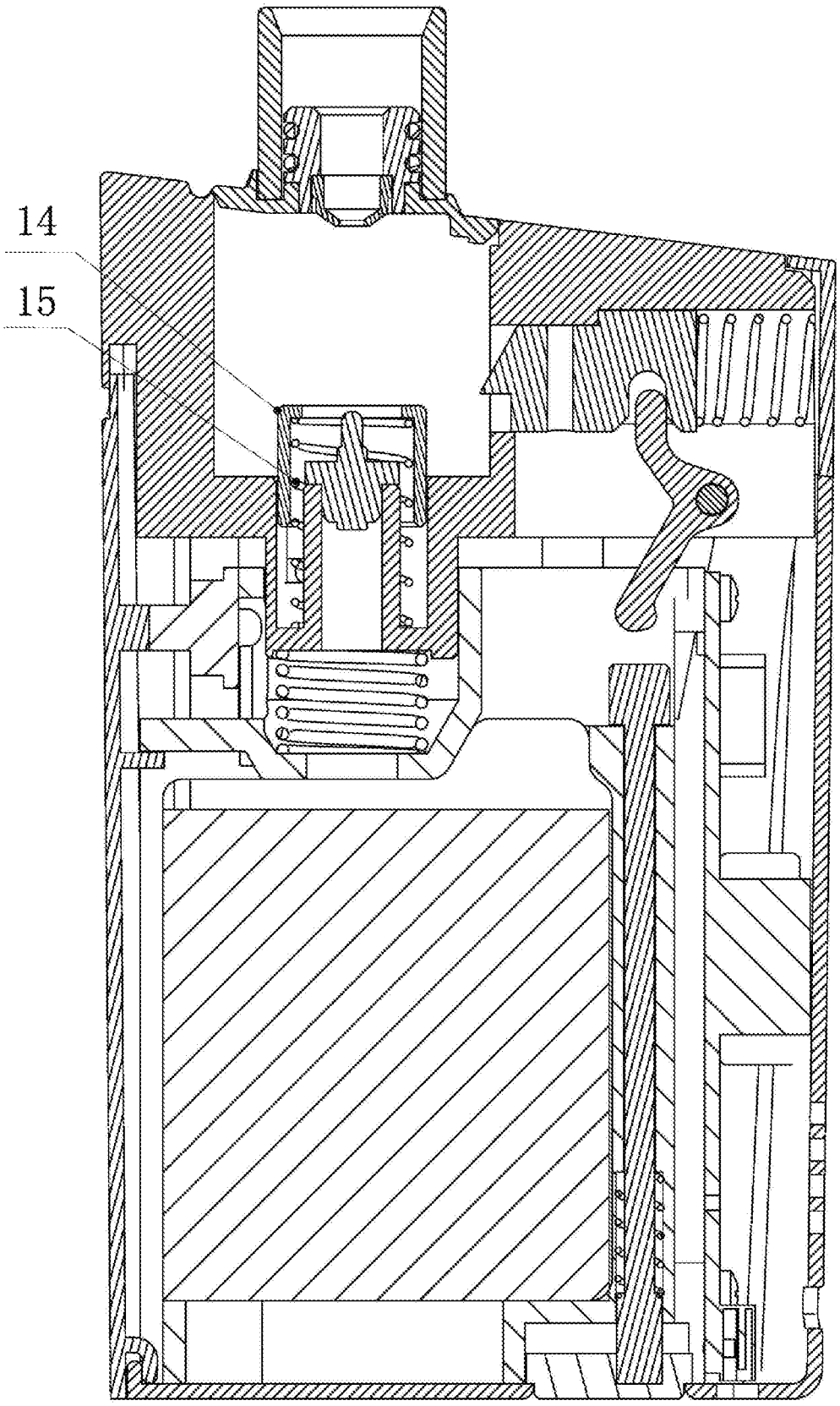
FIG. 20 is a schematic structural diagram when an atomization assembly is not mounted and the top cover assembly is not opened.
Figure 21:
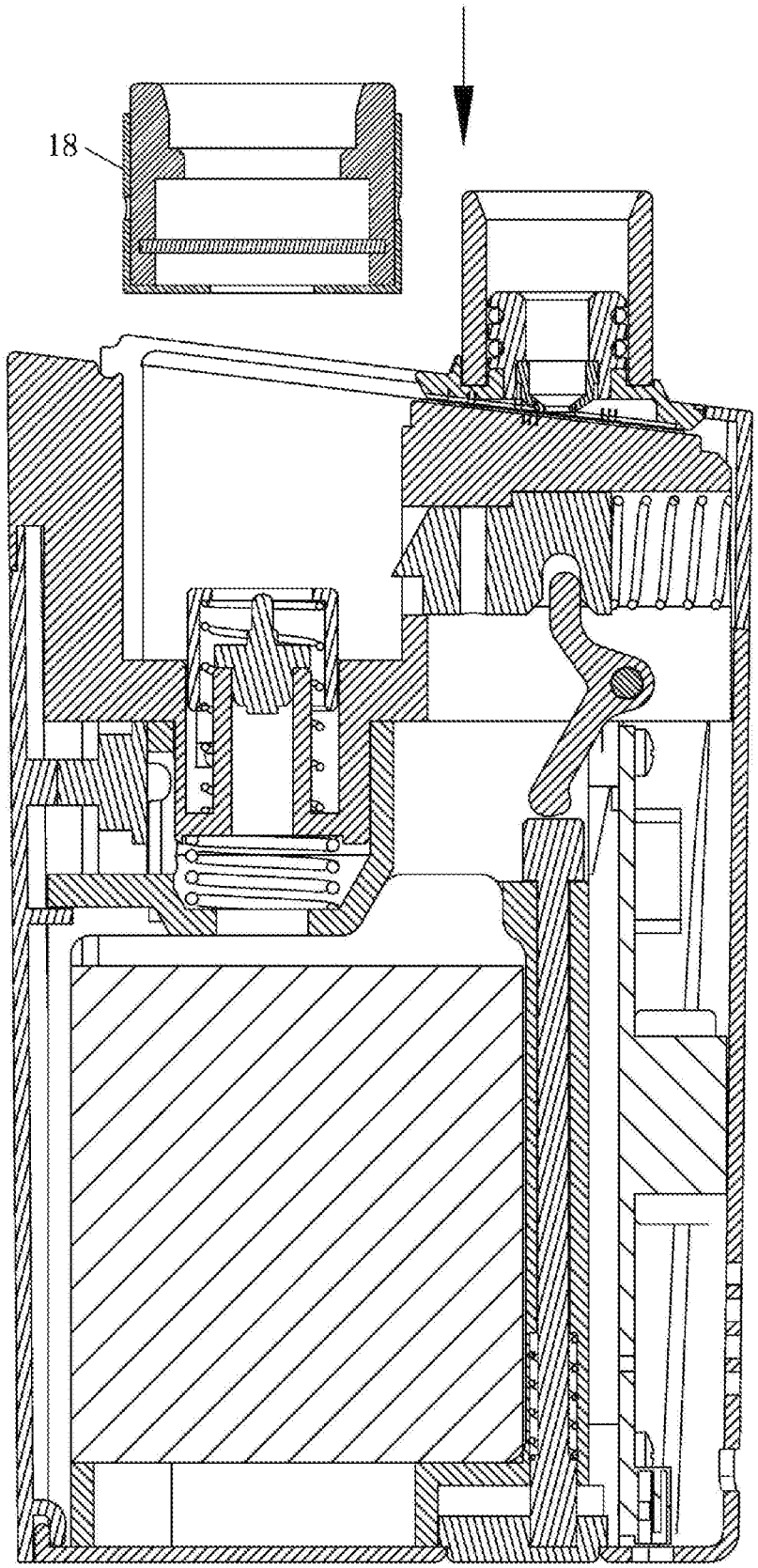
FIG. 21 is a schematic structural diagram when the top cover assembly is opened and the atomization assembly is being assembled.
Figure 22:
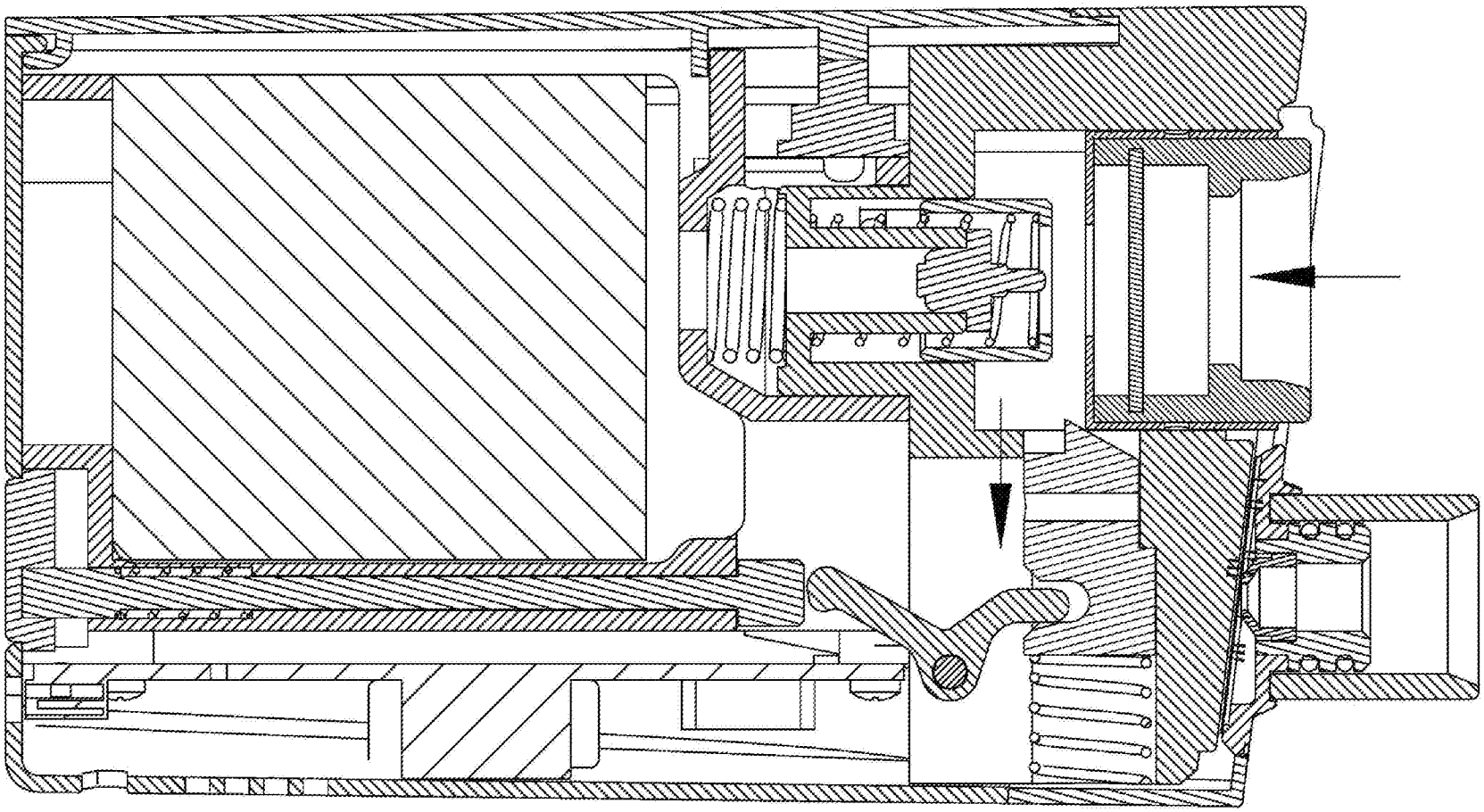
FIG. 22 and FIG. 23 are schematic structural diagrams when the atomization assembly is assembled.
Figure 23:
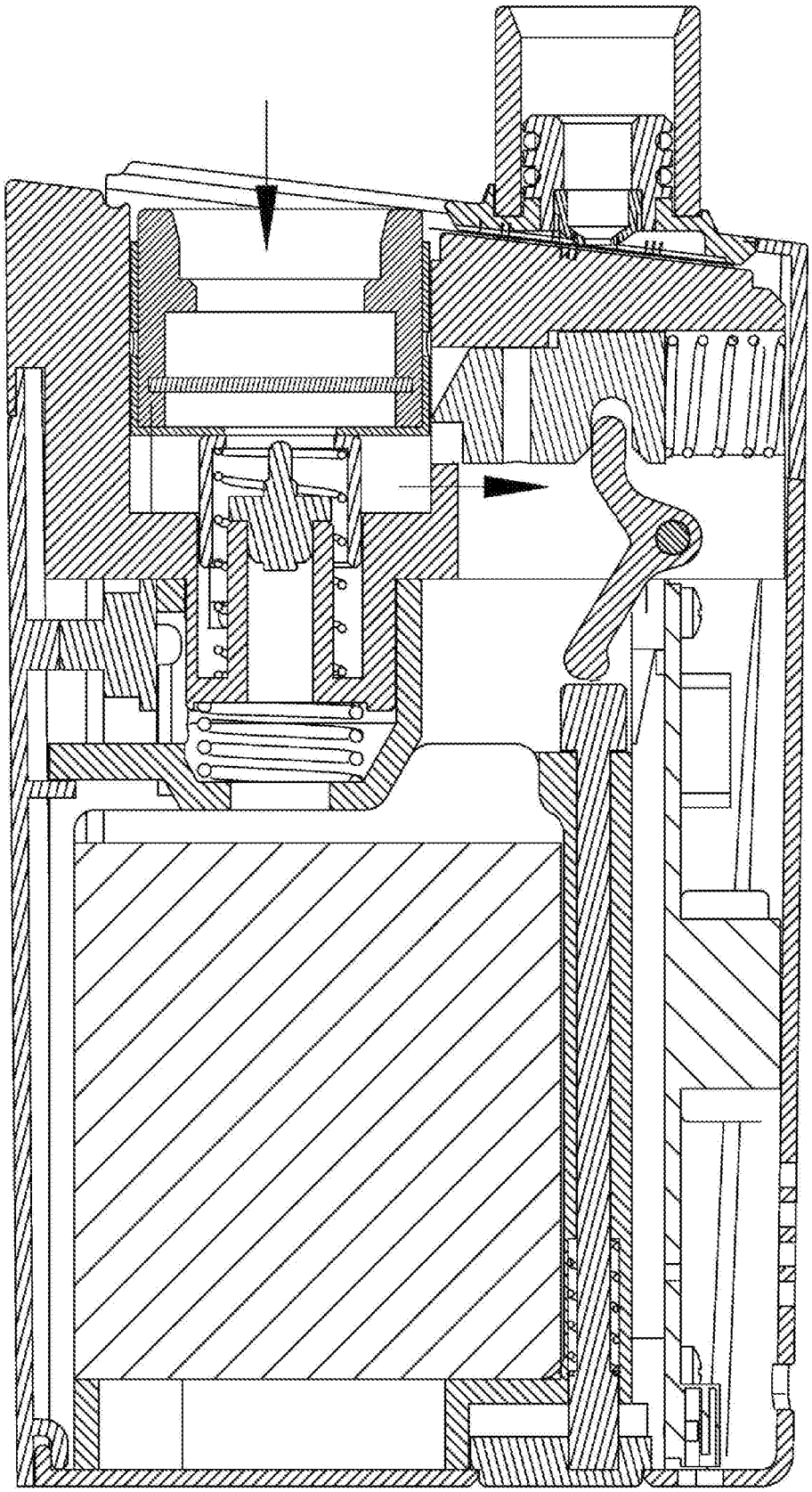
Figure 24:
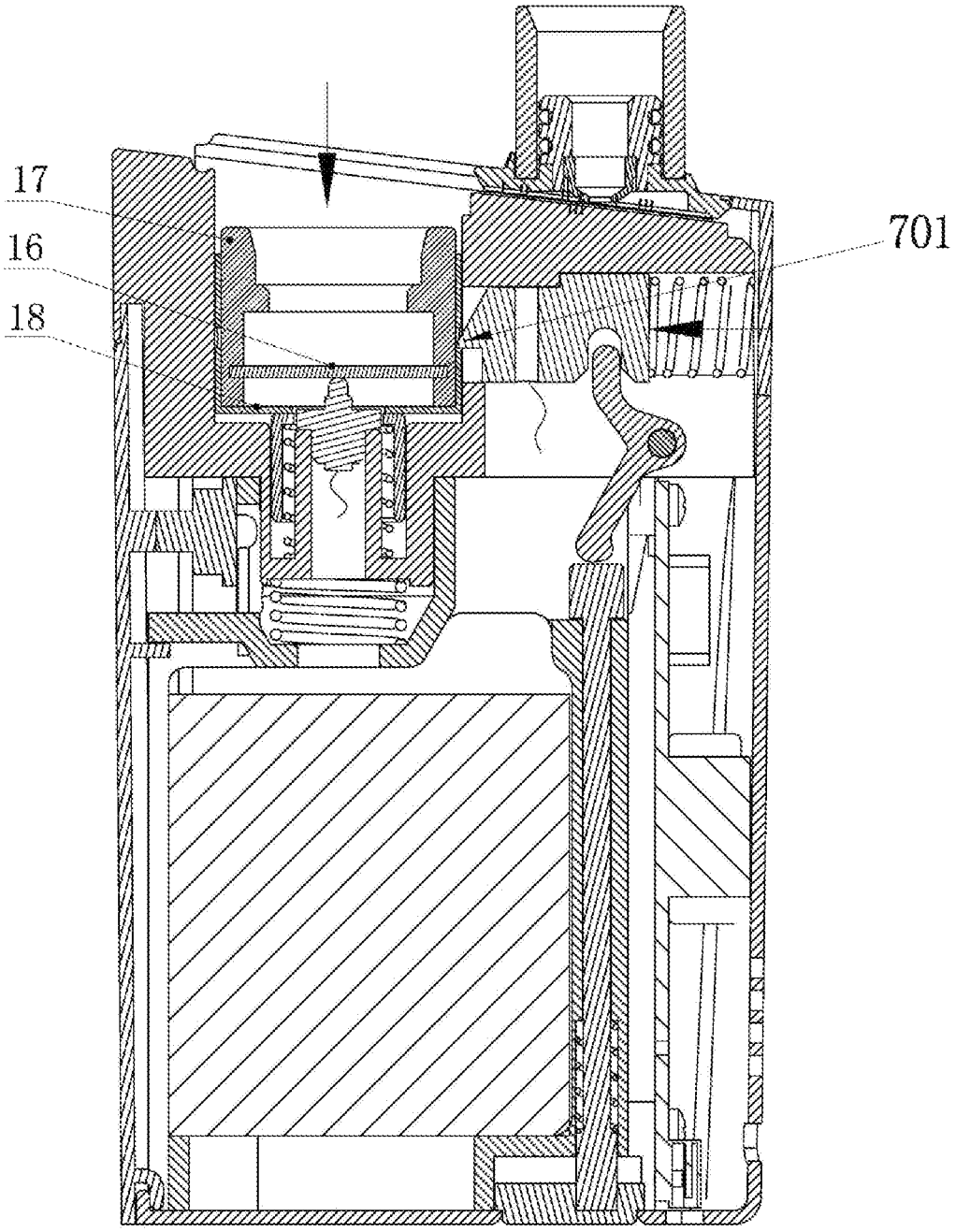
FIG. 24 is a schematic structural diagram after the atomization assembly is assembled.
Figure 25:
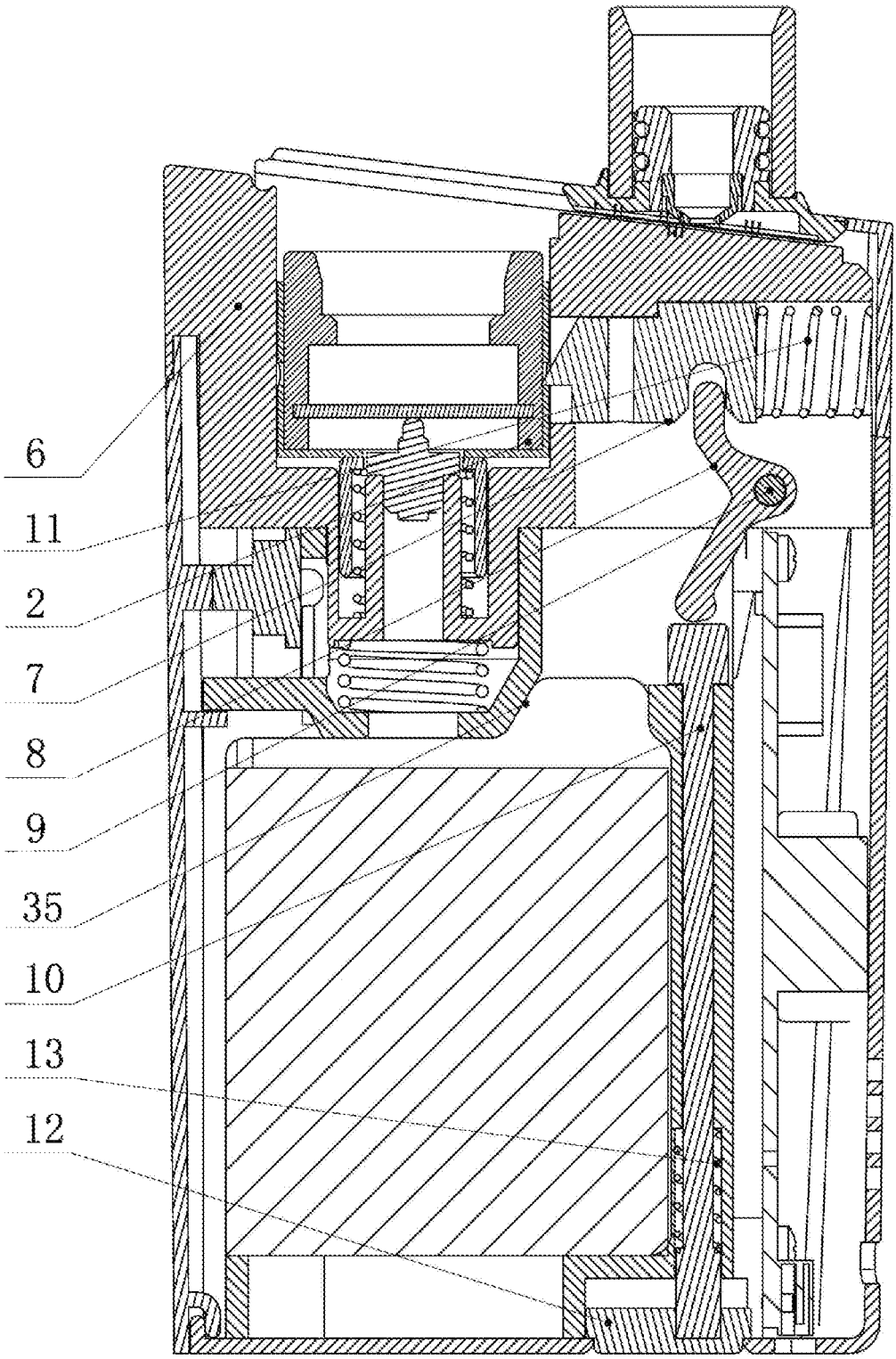
FIG. 25 is a schematic structural diagram when the top cover assembly is opened and the atomization assembly is not unlocked.
Figure 26:
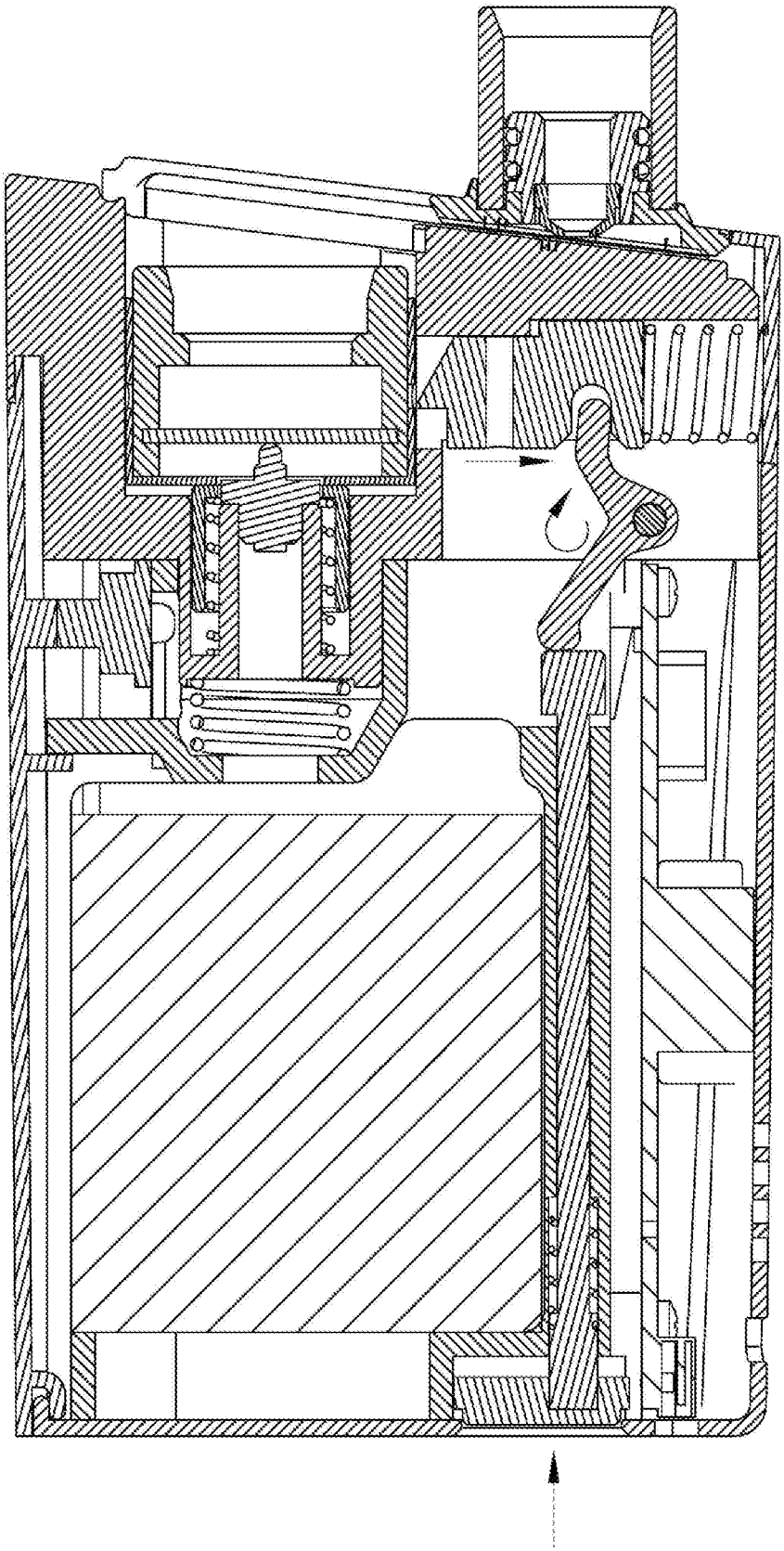
FIG. 26 is a schematic structural diagram when the atomization assembly is being unlocked.
Figure 27:
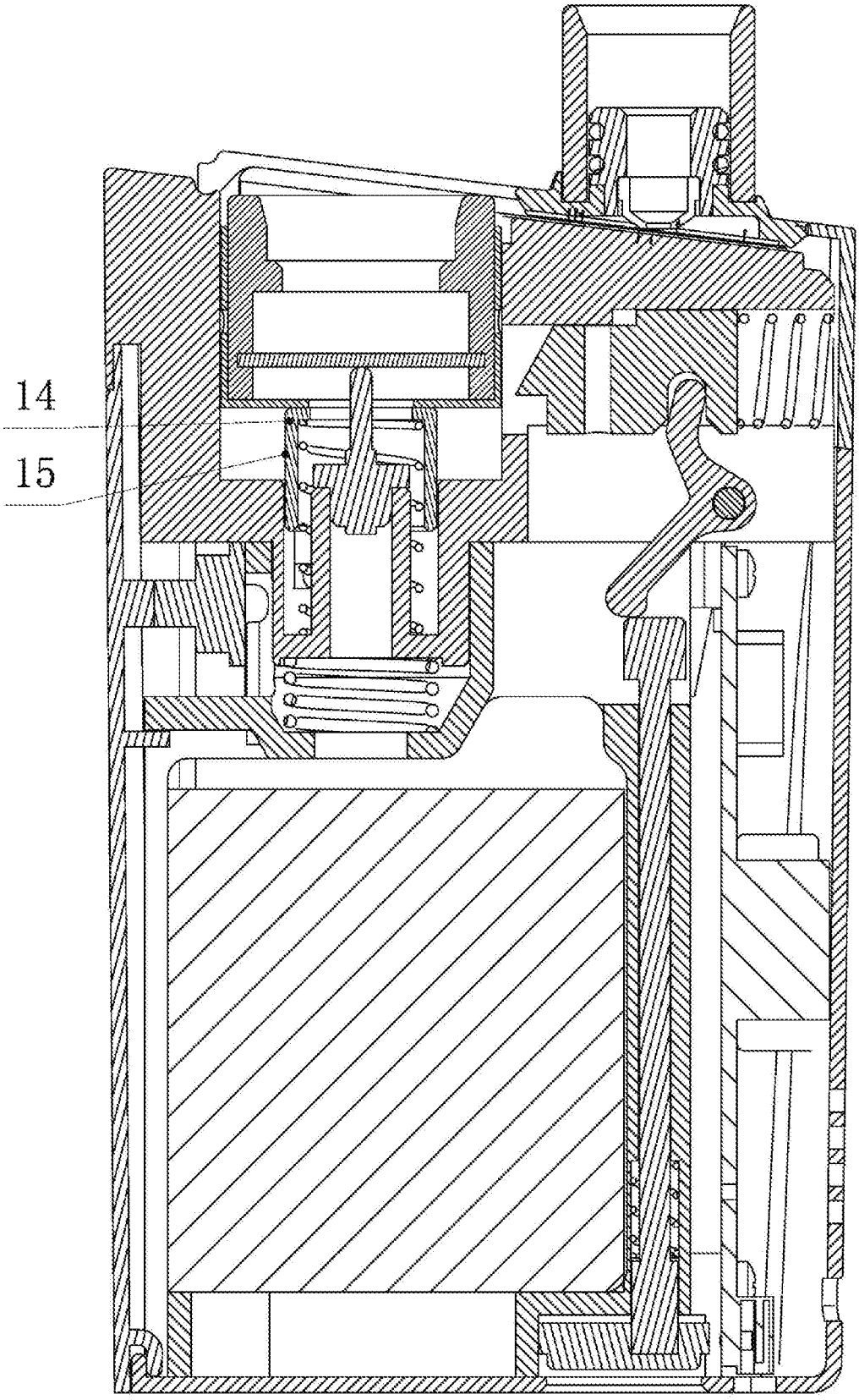
FIG. 27 is a schematic structural diagram when the atomization assembly is unlocked and is ejected upward.
Figure 28:
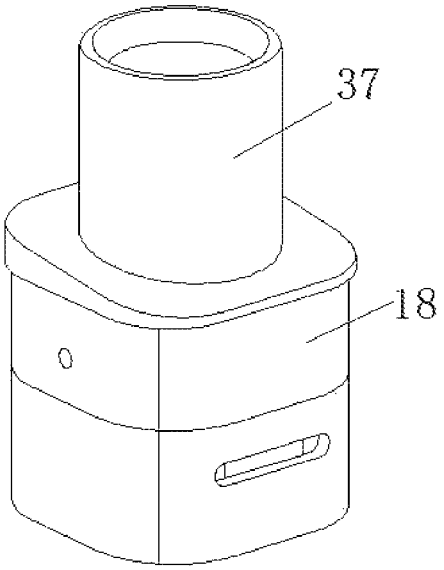
FIG. 28 is an external schematic diagram of an integrated structure of a suction nozzle, a cartridge and an atomization assembly in a second embodiment of the present invention.
Figure 29:
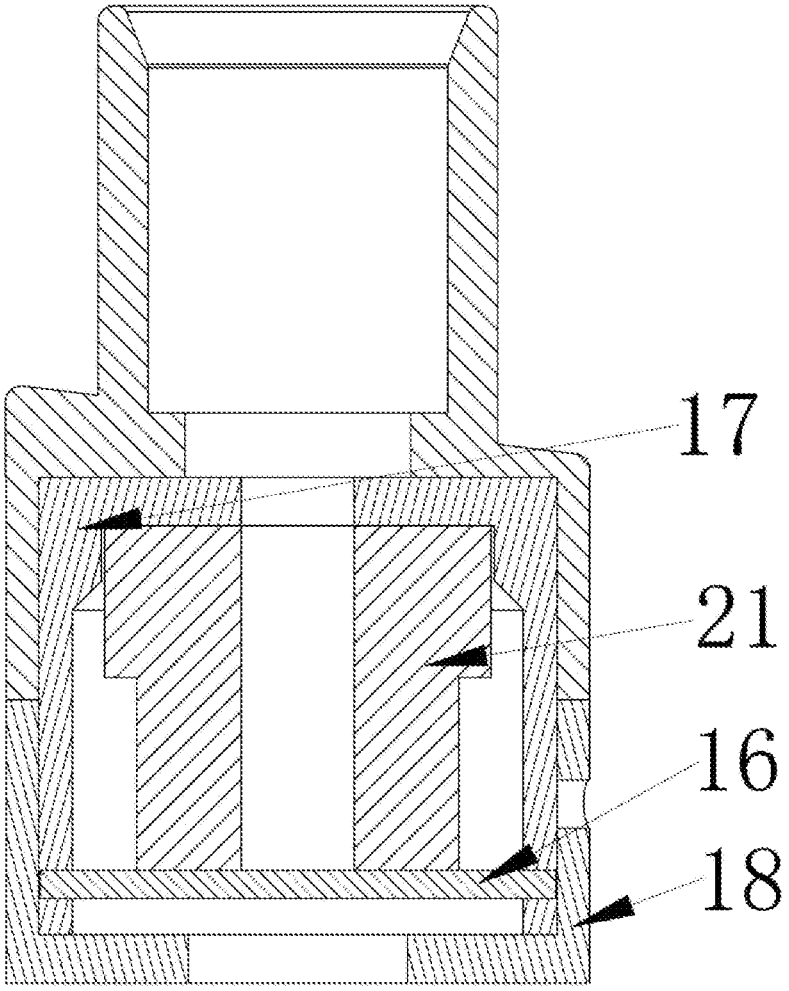
FIG. 29 is a front cross-sectional view of FIG. 28.
Figure 30:
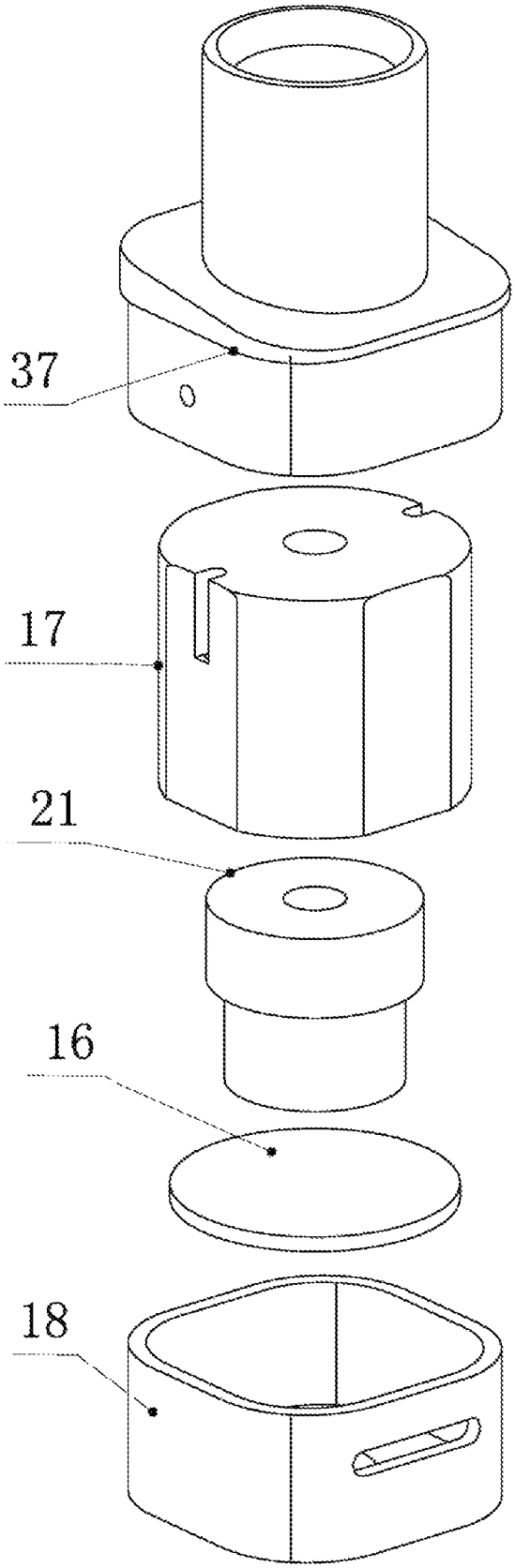
FIG. 30 is an exploded view of FIG. 28.
Figure 31:
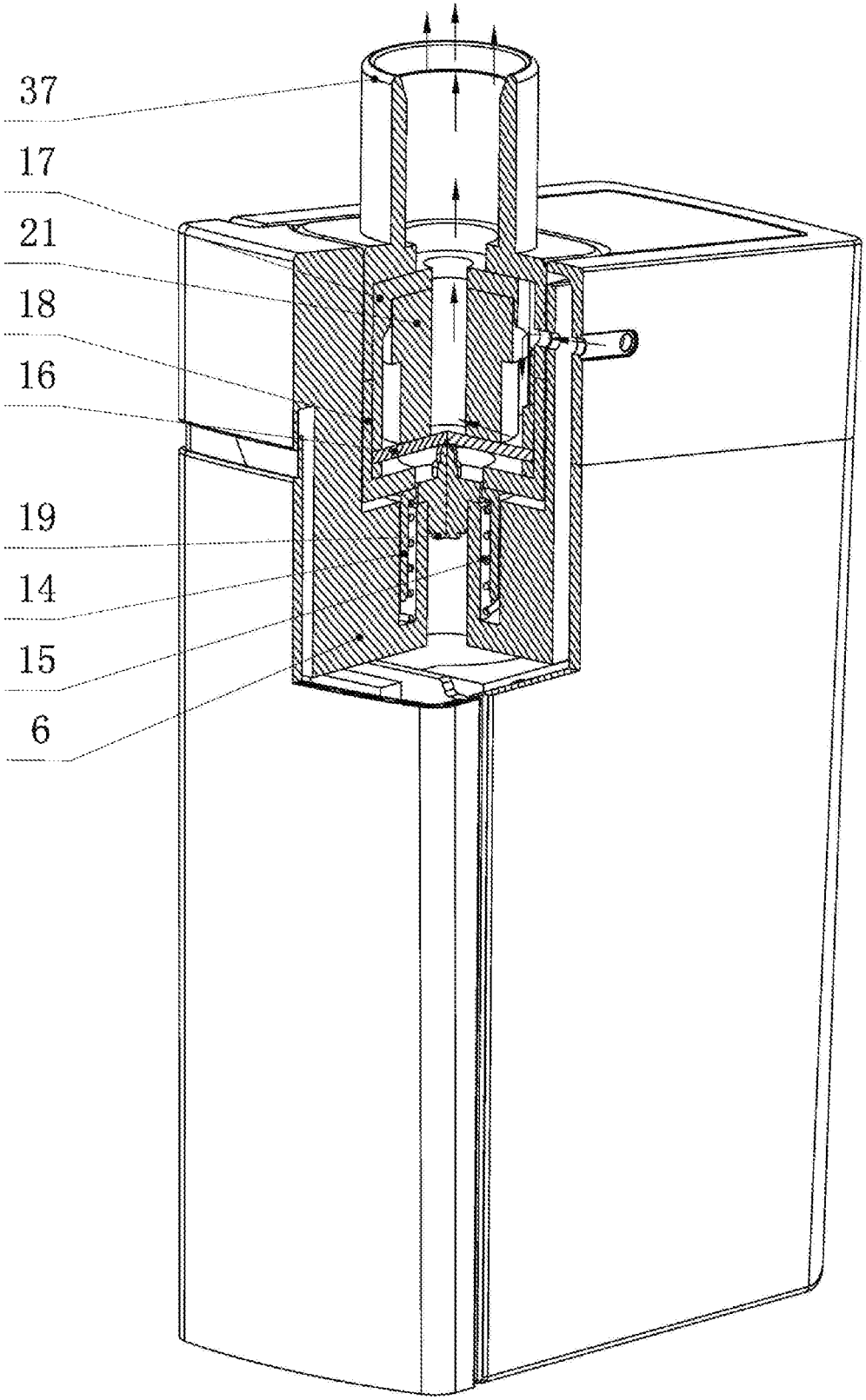
FIG. 31 is a schematic structural diagram of the second embodiment of the present invention.
Figure 32:
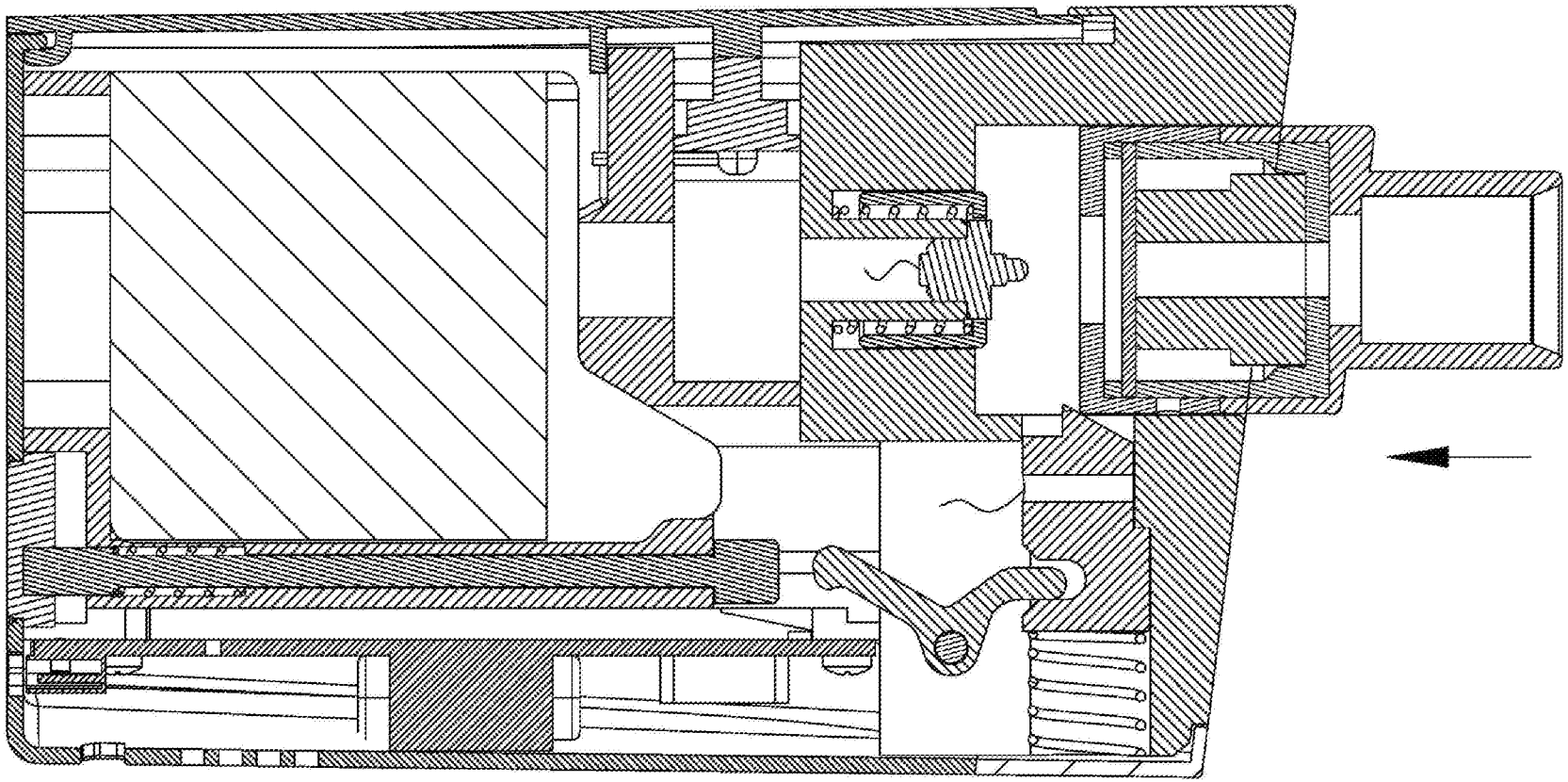
FIG. 32 is a schematic structural diagram of the second embodiment of the present invention when the atomization assembly is mounted.
Figure 33:
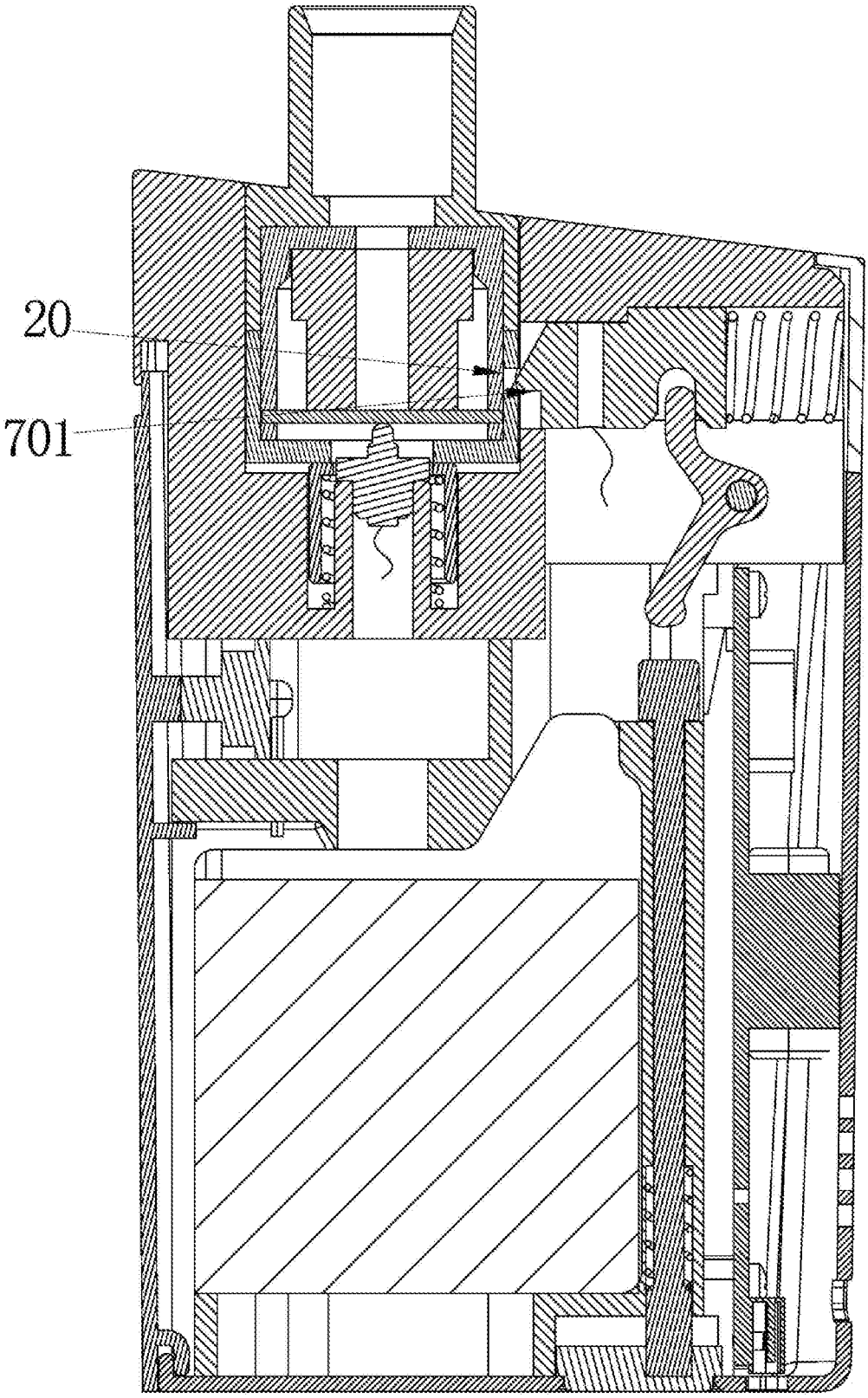
FIG. 33 is a schematic structural diagram of the second embodiment of the present invention after the atomization assembly is assembled.

As shown in FIG. 17 to FIG. 19, the two operations of replacing the cartridge 21 and pressing the large key 33 in the present invention are interlocked:

a. A limiting boss is provided in the hidden slot 608 of the sliding column 6, and the hidden portion at the top of the large key 33 is provided with a vertical limiting slot 3302; and after the electronic cigarette is assembled, the hidden portion is inserted into the hidden slot 608, the limiting boss and the vertical limiting slot 3302 are correspondingly arranged, and the bottom end face of the limiting boss is flush with but not in contact with the top end face of the hidden portion at the top of the large key 33.

b. When the sliding column 6 is pressed down, the hidden portion of the large key 33 is inserted into the hidden slot 608 of the sliding column 6 and the limiting boss is also inserted into the vertical limiting slot 3302, the limiting boss restrains the large key 33 from moving to the right, and the user cannot press the large key 33 at this time, which can prevent the electronic cigarette from operating and the ultrasonic atomization sheet 16 from being burnt out by accidentally touching the large key 33 when the sliding column 6 is pressed to replace the cartridge 21.

c. When smoking, the large key 33 is pressed, and the top surface of the hidden portion on the large key 33 abuts against the limiting boss of the sliding column 6, so the sliding column 6 cannot be pushed down to ensure that the cartridge 21 cannot be replaced during smoking of the electronic cigarette.

As shown in FIG. 20 to FIG. 27, in the first embodiment, the process of replacing the atomization assembly 2 is as follows:

a. The top cover 24 is opened: due to the elastic force applied to the right by the fifth spring 26, when the sliding assembly 38 is pressed down and the top cover assembly 23 is released, the top cover 24 can slide to the right along the guide slots 2501 of the guide plate 25. The first spring 15 is disposed in the top column 14, and the lug 1401 of the top column 14 is assembled corresponding to the semi-circular mounting groove 603 of the sliding column 6 and rotates along the rotation guide slot 604. Since the first spring 15 always applies an upward force to the top column 14, when the upper end face of the lug 1401 of the top column 14 moves up to the limiting end face 6051, the top column 14 is limited without separation.

b. The process of assembling the atomization assembly 2: the second spring 11 is disposed on the right end face of the slider 7, and the second spring 11 applies a leftward force to the slider 7, so that the slider 7 always has a tendency to move to the left. Buckling grooves 20 are formed on four sides of the conductive ring 18, a buckling portion 701 is provided at the end of the slider 7, and when the conductive ring 18 begins to contact the slider 7, since the end of the slider 7 is in a bevel shape, the atomization assembly 2 can be continuously pressed down to assemble, and the slider 7 will be squeezed to move to the right. The atomization assembly 2 is then pressed down to assemble, and the bottom of the conductive ring 18 begins to contact the top column 14, so that the pressing hand feel is better, until the buckling portion 701 of the slider 7 is stuck into the buckling groove 20 of the conductive ring 18, and the atomization assembly 2 is locked. Since the sealing seat 17 is made of soft silicone, the lead can directly penetrate the sealing seat 17 to the outside and is in contact with the conductive ring 18 by pressing. The first spring 15 is disposed below the top column 14, the first spring 15 applies an upward force to the top column 14, and the top surface of the top column 14 applies an upward force to the conductive ring 18, so that the atomization assembly 2 has a tendency to move up, the buckling groove 20 of the conductive ring 18 is in close contact with the slider 7, and the positive and negative leads of the atomization assembly 2 are in good contact, that is, the atomization assembly 2 can operate normally after being locked.

c. State of unlocking the atomization assembly 2: a vertical limiting step 602 is provided on the sliding column 6 corresponds to the slider 7, which is used as a limit position for the slider 7 to move to the left, and the first plane 6011 is opposite to the second plane 702 such that the slider 7 does not rotate during movement. The fourth spring 13 penetrates the bottom of the ejector rod 10, the ejector rod 10 is fixed with the key block 12 by riveting, the rotating tongue 8 is limited within the sliding column 6 by penetration of the rotating shaft 9, the top of the rotating tongue 8 is embedded in a U-shaped slot of the slider 7, and the slider 7 slides inside the circular receiving hole 601 of the sliding column 6. When the key block 12 is pressed up, the rotating tongue 8 rotates clockwise, the slider 7 is driven to move to the right, the slider 7 is separated from the atomization assembly 2, the first spring 15 is disposed below the top column 14, the first spring 15 always applies an upward force to the top column 14, and because the slider 7 is instantaneously separated from the atomization assembly 2, the atomization assembly 2 is instantaneously lifted by the top column 14, that is, the atomization assembly 2 can be poured down. After the atomization assembly 2 is unlocked, the second spring 11 has a leftward elastic force on the slider 7, and the slider 7 is reset to drive the rotating tongue 8 to reset; and the fourth spring 13 has a downward elastic force on the ejector rod 10 to reset the key block 12.

Embodiment 2

As shown in FIG. 28 to FIG. 33, the structure of the second embodiment of the electronic cigarette is similar to that of the first embodiment, except that a cartridge 21 is also provided in the groove at the top of the sliding column 6, a suction nozzle 37 is provided at the top of the housing 1, and the suction nozzle 37, the cartridge 21 and the atomization assembly 2 are connected into a whole. The atomization assembly 2, the cartridge 21 and the suction nozzle 37 can be replaced as a whole, which is more convenient. The same structure in the second embodiment as in the first embodiment is not described herein, which does not affect the understanding and implementation of the present invention by those skilled in the art.

Embodiment 3

Figure 34:
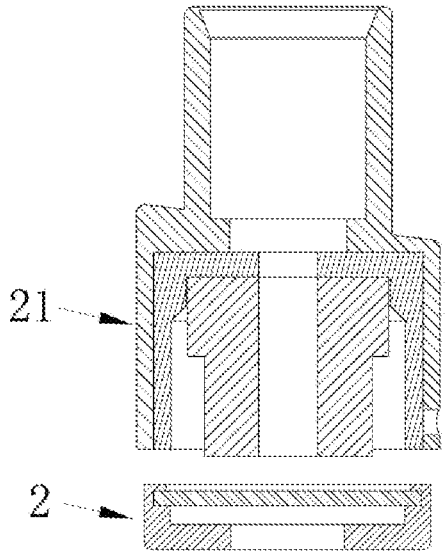
FIG. 34 is an exploded view of a cartridge and an atomization assembly in a third embodiment of the present invention.
Figure 35:
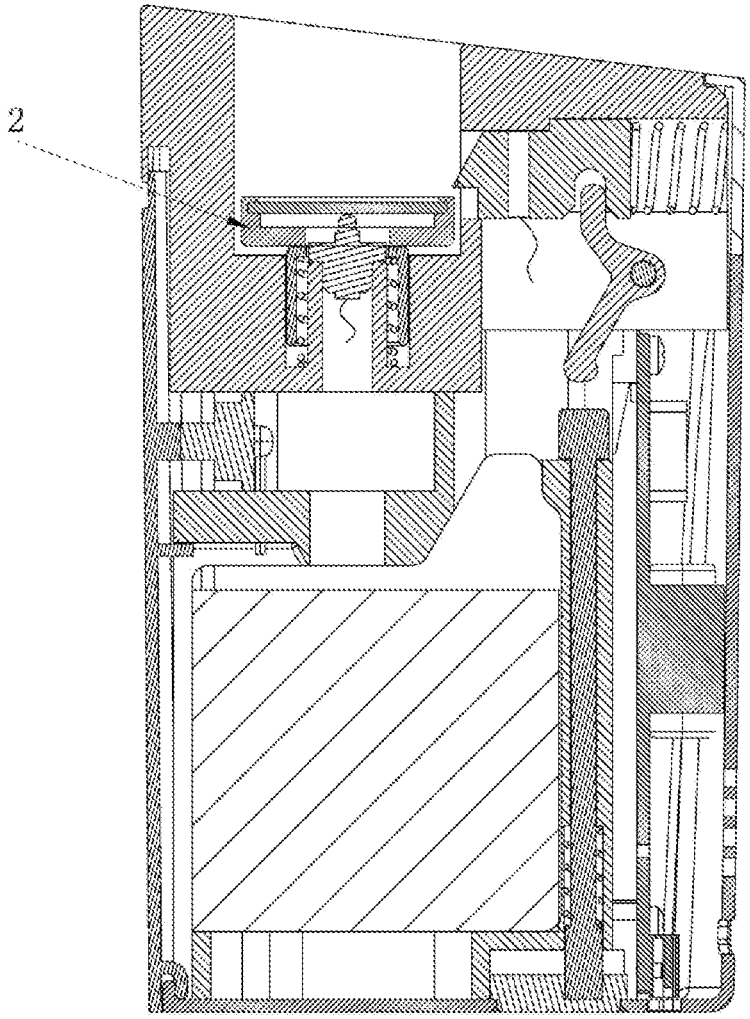
FIG. 35 is a schematic structural diagram of the third embodiment of the present invention after the atomization assembly is assembled.
Figure 36:
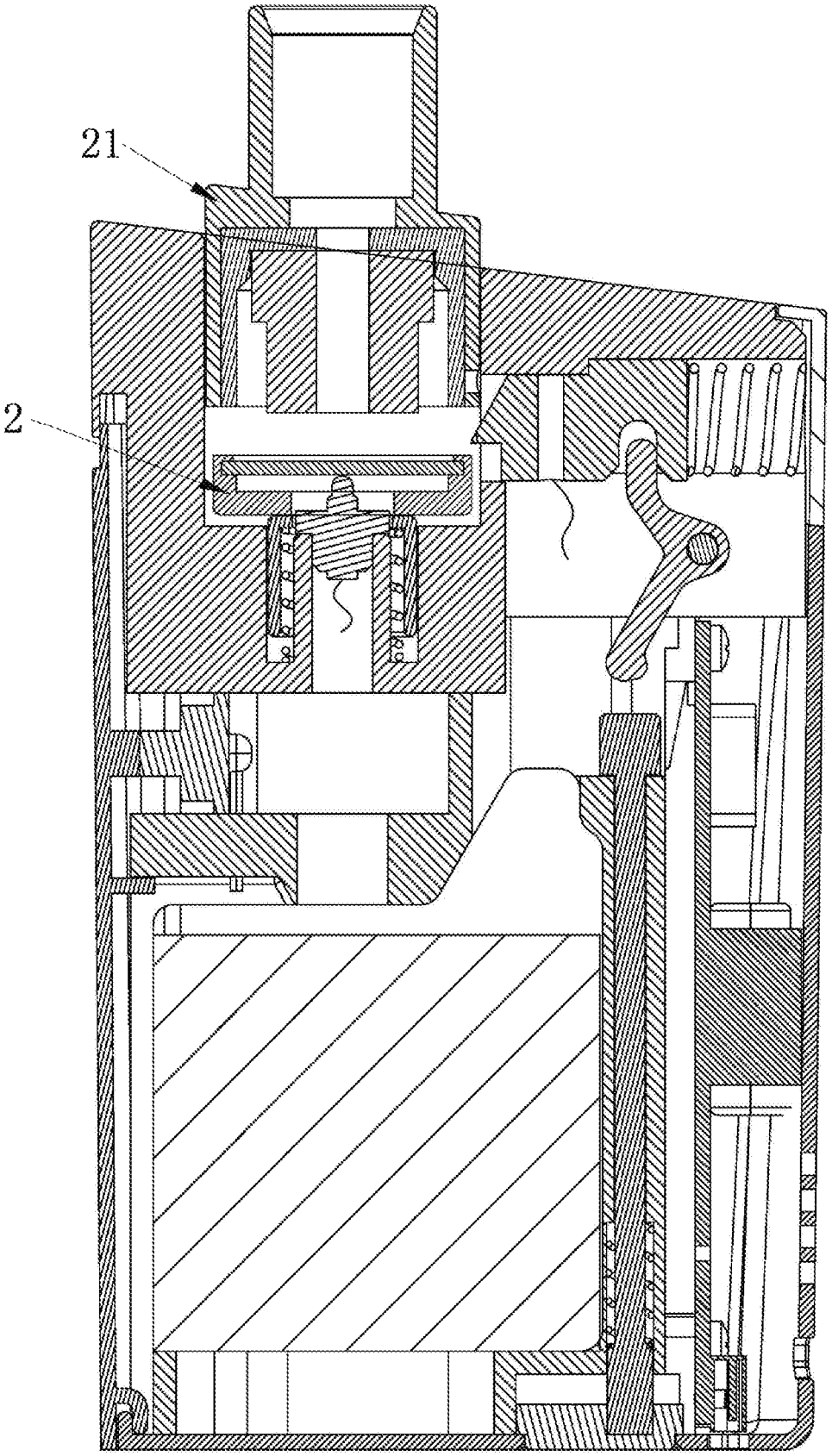
FIG. 36 is a schematic structural diagram of the third embodiment of the present invention when the cartridge is assembled.

As shown in FIG. 34 to FIG. 36, the structure of the third embodiment of the electronic cigarette is similar to that of the first embodiment, except that a cartridge 21 is also provided in the groove at the top of the sliding column 6, a suction nozzle 37 is provided at the top of the housing 1, the atomization assembly 2 includes an ultrasonic atomization sheet 16 and a conductive ring 18 outside the ultrasonic atomization sheet 16, the cartridge 21 is disposed in the suction nozzle 37, a sealing seat 17 is disposed between the cartridge 21 and the suction nozzle 37, and the cartridge 21, the sealing seat 17 and the suction nozzle 37 are connected into a whole; a buckling groove 20 corresponding to the buckling portion 701 is formed in the side wall of the suction nozzle 37; one pole of the ultrasonic atomization sheet 16 abuts against an elastic electrode 19 and is electrically connected to one pole of a power supply through the elastic electrode 19; a lead in pressing contact with the conductive ring 18 is welded to the other pole of the ultrasonic atomization sheet 16, and the slider 7 is welded with a lead and electrically connected to the other pole of the power supply; and when the buckling portion 701 locks the buckling groove 20, the suction nozzle 37 abuts against the conductive ring 18. In the locked state, the buckling groove 20 on the cartridge 21 is clamped by the buckling portion 701 on the slider 7, and the atomization assembly 2 is pressed and conductive. The atomization assembly 2 and the cartridge 21 are two independent parts, the outer diameter of the atomization assembly 2 is smaller than the outer diameter of the cartridge 21, and the both can be replaced separately, so that the use cost can be reduced and the assembly is more convenient and faster. The same structure in the third embodiment as in the first embodiment is not described herein, which does not affect the understanding and implementation of the present invention by those skilled in the art.

Embodiment 4

Figure 37:
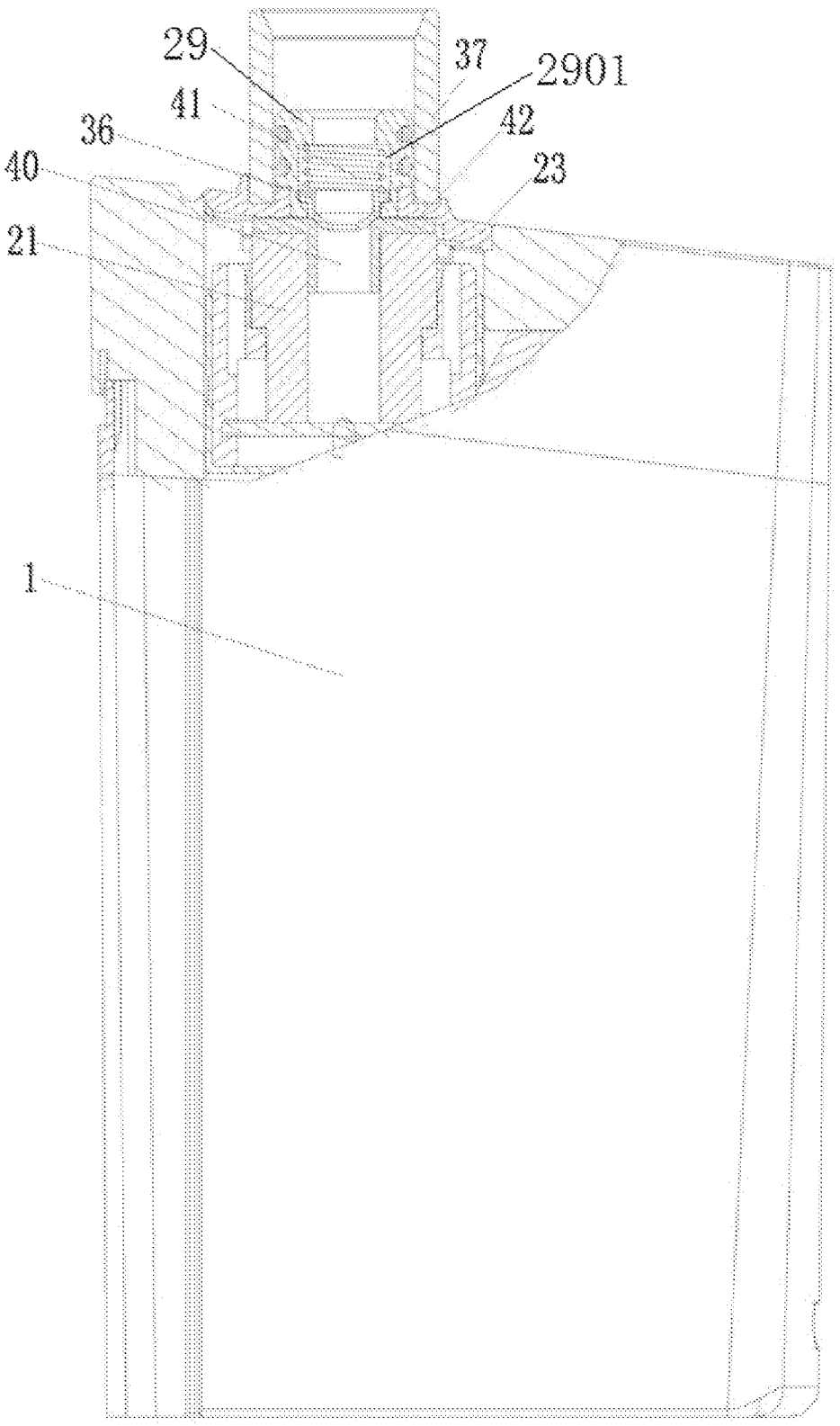
FIG. 37 is a schematic structural diagram of a fourth embodiment of the present invention.

As shown in FIG. 37, the structure of the fourth embodiment of the electronic cigarette is similar to that of the first embodiment, except that:

The top cover assembly also includes an adjusting spring 41 and a step shaft 29 in the suction nozzle 37, an adjusting slot 2901 is formed on the inner side wall of the step shaft 29, the large end of the tapered seal ring 36 is disposed in the adjusting slot 2901 and can move within the adjusting slot 2901, a top end of the adjusting spring 41 abuts against the top surface of the adjusting slot 2901, and the bottom end of the adjusting spring 41 abuts against the large end of the tapered seal ring 36. The tapered seal ring 36 is made of hard rubber. The hard rubber is plastic.

A cartridge 21 is disposed in the housing 1, an air outlet tube 42 is disposed between the cartridge 21 and the top cover assembly 23, and a central hole of the cartridge 21 is communicated with the air outlet tube 42 to form the air outlet channel 40.

The same structure in the fourth embodiment as in the first embodiment is not described herein, which does not affect the understanding and implementation of the present invention by those skilled in the art.

The embodiments of the present invention are described above with reference to the drawings, but the present invention is not limited to the specific embodiments. The specific embodiments described above are merely illustrative but not restrictive. Many forms may also be made by those of ordinary skilled in the art under the enlightenment of the present invention without departing from the purpose of the present invention and the scope of the claims, and these forms fall into the scope of the present invention.

The invention claimed is:

1. An electronic cigarette, comprising:

a housing (1), an atomization assembly (2) being disposed in the housing (1), a fixing mechanism (3) capable of fixing the atomization assembly (2), an unlocking mechanism (4) for controlling the fixing mechanism (3) to be relatively fixed to or separated from the atomization assembly (2), an elastic mechanism (5) for ejecting the atomization assembly (2) outward when the fixing mechanism (3) is separated from the atomization assembly (2); wherein:

the electronic cigarette further comprises a sliding column (6) at a top of the housing (1), the atomization assembly (2) is disposed in a groove at a top of the sliding column (6), the fixing mechanism (3) comprises a slider (7) disposed in a receiving hole (601) of the sliding column (6) and movable perpendicular to a length of the electronic cigarette, and a buckling portion (701) capable of fixing the atomization assembly (2) is provided at an end of the slider (7) close to the atomization assembly (2).

2. The electronic cigarette according to claim 1, wherein:

the unlocking mechanism (4) comprises a rotating tongue (8), a rotating shaft (9) and an ejector rod (10) all disposed in the housing (1), the ejector rod (10) is movable along the length of the electronic cigarette, a middle of the rotating tongue (8) is connected to the sliding column (6) through the rotating shaft (9), the rotating tongue (8) can rotate around the rotating shaft (9), one end of the rotating tongue (8) extends into a groove at a bottom of the slider (7), another end of the rotating tongue (8) is opposite to a top end of the ejector rod (10), and the top end of the ejector rod (10) can push the rotating tongue (8) to rotate and drive the slider (7) through the rotating tongue (8) to be separated from the atomization assembly (2).

3. The electronic cigarette according to claim 1, wherein:

the fixing mechanism (3) also comprises a second spring (11), one end of the second spring (11) abuts against the end of the slider (7) away from the atomization assembly (2), and another end of the second spring (11) abuts against an inner side wall of the housing (1).

4. The electronic cigarette according to claim 1, wherein:

a first plane (6011) is provided on an inner side wall of the receiving hole (601) to prevent the slider (7) from rotating, and a second plane (702) corresponding to the first plane (6011) is provided on the slider (7).

5. The electronic cigarette according to claim 1, wherein:

the elastic mechanism (5) comprises a top column (14) and a first spring (15) both disposed in a groove at a bottom of the sliding column (6), and the first spring (15) abuts between the sliding column (6) and the top column (14).

6. The electronic cigarette according to claim 5, wherein:

a lug (1401) is provided on an outer side wall of the top column (14), a mounting groove (603) corresponding to the lug (1401) is formed on a side wall of the sliding column (6), a rotation guide slot (604) and a vertical guide rail (605) are formed on the side wall of the sliding column (6), the mounting groove (603) is communicated with the vertical guide rail (605) through the rotation guide slot (604), and a limiting end face (6051) is provided on a top of the vertical guide rail (605).

7. The electronic cigarette according to claim 1, wherein the atomization assembly (2) comprises an ultrasonic atomization sheet (16) and a sealing seat (17) for fixing the ultrasonic atomization sheet (16);

wherein the atomization assembly (2) also comprises a conductive ring (18) outside the sealing seat (17);

wherein one pole of the ultrasonic atomization sheet (16) abuts against an elastic electrode (19) and is electrically connected to one pole of a power supply through the elastic electrode (19);

wherein:

a lead passing through the sealing seat (17) and in pressing contact with the conductive ring (18) is welded to another pole of the ultrasonic atomization sheet (16), a buckling groove (20) corresponding to the buckling portion (701) is formed on a side wall of the conductive ring (18), and the slider (7) is welded with a lead and is electrically connected to another pole of the power supply.

8. The electronic cigarette according to claim 7, wherein:

a cartridge (21) is also provided in the groove at the top of the sliding column (6), an upper cover assembly (22) and a top cover assembly (23) are provided on the top of the housing (1), the sliding column (6) can move along the length of the electronic cigarette, the cartridge (21) is disposed in the groove at the top of the sliding column (6), an atomization surface of the ultrasonic atomization sheet (16) is in contact with the cartridge (21), the top cover assembly (23) comprises a suction nozzle (37) and a top cover (24) connected with each other, the upper cover assembly (22) is provided with a guide slot (2501) for guiding the top cover assembly (23) to be opened, the top cover (24) has a guide portion (2401) cooperating with the guide slot (2501), and the sliding column (6) has a limiting portion (606) for limiting the top cover (24); and when the top cover assembly (23) is not opened, the limiting portion (606) abuts against an end face of the top cover (24).

9. The electronic cigarette according to claim 8, wherein:

a fifth spring (26) is also provided in the guide slot (2501), two fifth springs (26) are symmetrically disposed on two sides of the suction nozzle (37), one end of the fifth spring (26) abuts against the upper cover assembly (22), and another end of the fifth spring (26) abuts against the guide portion (2401);

wherein each fifth spring (26) is on one side of the corresponding guide portion (2401), and the limiting portion (606) is on another side of the guide portion (2401); and when the top cover assembly (23) is not opened, the fifth springs (26) are in a compressed state.

10. The electronic cigarette according to claim 7, wherein:

a cartridge (21) is also provided in the groove at the top of the sliding column (6), a suction nozzle (37) is provided at the top of the housing (1), and the suction nozzle (37), the cartridge (21) and the atomization assembly (2) are connected into a whole.

11. The electronic cigarette according to claim 1 wherein:

a cartridge (21) is also provided in the groove at the top of the sliding column (6), a suction nozzle (37) is provided at the top of the housing (1), the atomization assembly (2) comprises an ultrasonic atomization sheet (16) and a conductive ring (18) outside the ultrasonic atomization sheet (16), the cartridge (21) is disposed in the suction nozzle (37), a sealing seat (17) is disposed between the cartridge (21) and the suction nozzle (37), and the cartridge (21), the sealing seat (17) and the suction nozzle (37) are connected into a whole;

wherein a buckling groove (20) corresponding to the buckling portion (701) is formed on a side wall of the suction nozzle (37);

wherein one pole of the ultrasonic atomization sheet (16) abuts against an elastic electrode (19) and is electrically connected to one pole of a power supply through the elastic electrode (19);

wherein a lead in pressing contact with the conductive ring (18) is welded to another pole of the ultrasonic atomization sheet (16), and the slider (7) is welded with a lead and is electrically connected to another pole of the power supply; and when the buckling portion (701) locks the buckling groove (20), the suction nozzle (37) abuts against the conductive ring (18).

12. The electronic cigarette according to claim 8, wherein:

a switch key (32) for controlling the connection or disconnection of an operating circuit of the electronic cigarette is also disposed in the housing (1), and the electronic cigarette also comprises a limiting mechanism (607) capable of preventing a large key (33) from moving inward when the sliding column (6) moves down.

13. The electronic cigarette according to claim 12, wherein the limiting mechanism (607) comprises a limiting boss provided on the sliding column (6) and capable of abutting against an inner side face of the large key (33) when the sliding column (6) moves down.

14. The electronic cigarette according to claim 13, wherein:

when the top cover assembly (23) is locked, a top surface of the large key (33) and a bottom surface of the limiting boss are on the same plane but are not in contact with each other; and when the large key (33) is pressed, the top surface of the large key (33) abuts against the bottom surface of the limiting boss.

15. The electronic cigarette according to claim 13, wherein a vertical limiting slot (3302) matching the limiting boss is provided in a top of the inner side face of the large key (33).

16. The electronic cigarette according to claim 13, wherein:

a hidden slot (608) is provided at a position on the sliding column (6) corresponding to the limiting boss, and a top of the large key (33) extends into the hidden slot (608).

17. The electronic cigarette according to claim 8, wherein:

an air outlet channel (40) communicated with the suction nozzle (37) is also formed inside the housing (1), and a top cover assembly (23) also comprises a tapered seal ring (36) fixed in the suction nozzle (37); and when the top cover assembly (23) is not opened, a small end of the tapered seal ring (36) extends into the air outlet channel (40), a top of a side wall of the air outlet channel (40) abuts against an outer wall of the tapered seal ring (36), and the tapered seal ring (36) connects the air outlet channel (40) with the suction nozzle (37).

18. The electronic cigarette according to claim 17, wherein the top cover assembly (23) can slide relative to the air outlet channel (40) to open a top opening of the housing (1).

19. The electronic cigarette according to claim 8, wherein:

the top cover assembly also comprises an adjusting spring (41) and a step shaft (29) in the suction nozzle (37), an adjusting slot (2901) is formed on an inner side wall of the step shaft (29), a large end of the tapered seal ring (36) is disposed in the adjusting slot (2901) and can move within the adjusting slot (2901), a top end of the adjusting spring (41) abuts against a top surface of the adjusting slot (2901), and a bottom end of the adjusting spring (41) abuts against the large end of the tapered seal ring (36).

* * * * *